US007073891B2

(12) United States Patent
Shin et al.

(10) Patent No.: US 7,073,891 B2
(45) **Date of Patent: *Jul. 11, 2006**

(54) MONOLITHIC INK-JET PRINTHEAD HAVING A METAL NOZZLE PLATE AND MANUFACTURING METHOD THEREOF

(75) Inventors: Su-ho Shin, Suwon (KR); Yong-soo Oh, Seongam (KR); Keon Kuk, Yongin (KR); Hyung-taek Lim, Seoul (KR); Chang-seung Lee, Seongnam (KR); Seung-ju Shin, Seongnam (KR); Min-soo Kim, Seoul (KR); You-seop Lee, Yongin (KR)

(73) Assignee: Samsung Electronics Co., Ltd., Suwon (KR)

( * ) Notice: Subject to any disclaimer, the term of this patent is extended or adjusted under 35 U.S.C. 154(b) by 237 days.

This patent is subject to a terminal disclaimer.

(21) Appl. No.: 10/682,857

(22) Filed: Oct. 14, 2003

(65) Prior Publication Data

US 2004/0075707 A1 Apr. 22, 2004

(30) Foreign Application Priority Data

Oct. 12, 2002 (KR) ..... 10-2002-0062257

(51) Int. Cl.
*B41J 2/05* (2006.01)

(52) U.S. Cl. ..... 347/56; 347/61; 347/65

(58) Field of Classification Search ..... 347/17, 347/56, 65, 67, 18, 20, 47, 63
See application file for complete search history.

(56) References Cited

U.S. PATENT DOCUMENTS

| | | | | |
|---|---|---|---|---|
| 4,438,191 | A | 3/1984 | Cloutier et al. | 430/324 |
| 4,513,298 | A * | 4/1985 | Scheu | 347/64 |
| 4,580,149 | A * | 4/1986 | Domoto et al. | 347/61 |
| 4,694,308 | A | 9/1987 | Chan et al. | 346/140 |
| 4,882,595 | A | 11/1989 | Trueba et al. | 346/140 |
| 6,273,555 | B1 * | 8/2001 | Hess | 347/63 |
| 6,312,109 | B1 | 11/2001 | Chen | |
| 6,341,848 | B1 * | 1/2002 | Shade et al. | 347/63 |
| 6,561,626 | B1 * | 5/2003 | Min et al. | 347/47 |
| 6,649,074 | B1 * | 11/2003 | Lee et al. | 216/27 |
| 2002/0008738 | A1 | 1/2002 | Lee et al. | |

FOREIGN PATENT DOCUMENTS

| | | |
|---|---|---|
| EP | 0 110 534 | 6/1984 |

* cited by examiner

*Primary Examiner*—Manish Shah
*Assistant Examiner*—Geoffrey Mruk
(74) *Attorney, Agent, or Firm*—Lee & Morse, P.C.

(57) ABSTRACT

A monolithic ink-jet printhead includes a substrate having an ink chamber to be supplied with ink to be ejected on a front surface thereof, a manifold for supplying ink to the ink chamber on a rear surface thereof, and an ink channel in communication with the ink chamber and the manifold, a nozzle plate including a plurality of passivation layers stacked on the substrate and a heat dissipating layer overlying the passivation layers, the nozzle plate having a nozzle penetrating the nozzle plate, a heater formed between adjacent passivation layers and located above the ink chamber for heating the ink to be supplied within the ink chamber, and a conductor provided between adjacent passivation layers, the conductor being electrically connected to the heater for applying current across the heater, wherein the heat dissipating layer is made of a thermally conductive metal for dissipating heat from the heater.

18 Claims, 17 Drawing Sheets

MONOLITHIC INK-JET PRINTHEAD HAVING A METAL NOZZLE PLATE AND MANUFACTURING METHOD THEREOF

BACKGROUND OF THE INVENTION

1. Field of the Invention

The present invention relates to an ink-jet printhead. More particularly, the present invention relates to a thermally driven monolithic ink-jet printhead in which a metal nozzle plate is formed integrally with a substrate and a manufacturing method thereof.

2. Description of the Related Art

Ink-jet printheads are devices for printing a predetermined color image by ejecting a small droplet of a printing ink at a desired position on a recording sheet. Ink-jet printheads are largely categorized into two types depending on the ink droplet ejection mechanisms: a thermally driven ink-jet printhead, in which a heat source is employed to form and expand bubbles in ink causing an ink droplet to be ejected, and a piezoelectrically driven ink-jet printhead, in which a piezoelectric crystal bends to exert pressure on ink causing an ink droplet to be expelled.

An ink ejection mechanism of the thermally driven ink-jet printhead will now be described in detail. When a current pulse flows through a heater consisting of a resistive heating material, heat is generated by the heater to rapidly heat ink near the heater to approximately 300° C. thereby causing the ink to boil and form bubbles. The formed bubbles expand to exert pressure on ink contained within an ink chamber. This pressure causes a droplet of ink to be ejected through a nozzle from the ink chamber.

A thermally driven ink-jet printhead can be further subdivided into top-shooting, side-shooting, and back-shooting types depending on the direction in which the ink droplet is ejected and the direction in which a bubble expands. While the top-shooting type refers to a mechanism in which an ink droplet is ejected in a direction the same as a direction in which a bubble expands, the back-shooting type is a mechanism in which an ink droplet is ejected in a direction opposite to a direction in which a bubble expands. In the side-shooting type, the direction of ink droplet ejection is perpendicular to the direction of bubble expansion.

Thermally driven ink-jet printheads need to meet the following conditions. First, a simple manufacturing process, low manufacturing cost, and mass production must be provided. Second, to produce high quality color images, the distance between adjacent nozzles must be as small as possible while still preventing cross-talk between the adjacent nozzles. More specifically, to increase the number of dots per inch (DPI), many nozzles must be arranged within a small area. Third, for high speed printing, a cycle beginning with ink ejection and ending with ink refill must be as short as possible. That is, the heated ink and heater should cool down quickly to increase an operating frequency.

FIG. 1A illustrates a partial cross-sectional perspective view showing a structure of a conventional thermally driven printhead. FIG. 1B illustrates a cross-sectional view of the printhead of FIG. 1A for explaining a process of ejecting an ink droplet.

Referring to FIGS. 1A and 1B, a conventional thermally driven ink-jet printhead includes a substrate 10, a barrier wall 14 disposed on the substrate 10 for defining an ink chamber 26 filled with ink 29, a heater 12 disposed in the ink chamber 26, and a nozzle plate 18, having a nozzle 16 for ejecting an ink droplet 29'. If a current pulse is supplied to the heater 12, the heater 12 generates heat to form a bubble 28 in the ink 29 within the ink chamber 26. The bubble 28 expands to exert pressure on the ink 29 present in the ink chamber 26, which causes an ink droplet 29' to be expelled through the nozzle 16. Then, the ink 29 is introduced from a manifold 22 through an ink feed channel 24 to refill the ink chamber 26.

The process of manufacturing a conventional top-shooting type ink-jet printhead configured as above involves separately manufacturing the nozzle plate 18 equipped with the nozzle 16 and the substrate 10 having the ink chamber 26 and ink feed channel 24 formed thereon and bonding them to each other. These required steps complicate the manufacturing process and may cause a misalignment during the bonding of the nozzle plate 18 with the substrate 10. Furthermore, since the ink chamber 26, the ink channel 24, and the manifold 22 are arranged on the same plane, there is a restriction on increasing the number of nozzles 16 per unit area, i.e., the density of nozzles 16. This restriction makes it difficult to implement a high printing speed, high resolution ink-jet printhead.

Recently, in an effort to overcome the above problems of conventional ink-jet printheads, ink-jet printheads having a variety of structures have been proposed. FIGS. 2A and 2B illustrate a conventional monolithic ink-jet printhead. FIGS. 2A and 2B illustrate a plan view showing an example of a conventional monolithic ink-jet printhead and a vertical cross-sectional view taken along line A–A' of FIG. 2A, respectively.

Referring to FIGS. 2A and 2B, a hemispherical ink chamber 32 and a manifold 36 are formed on a front surface, i.e., an upper surface, and a rear surface, i.e., a lower surface, of a silicon substrate 30, respectively, and an ink channel 34 connects the ink chamber 32 with the manifold 36 at a bottom of the ink chamber 32. A nozzle plate 40 comprised of a plurality of stacked material layers 41, 42, and 43 is formed integrally with the substrate 30. The nozzle plate 40 has a nozzle 47 at a location corresponding to a central portion of the ink chamber 32. A heater 45 connected to a conductor 46 is disposed around the nozzle 47. A nozzle guide 44 extends along an edge of the nozzle 47 toward the ink chamber 32. Heat generated by the heater 45 is transferred through an insulating layer 41 to ink 48 within the ink chamber 32. The ink 48 then boils to form bubbles 49. The created bubbles 49 expand to exert pressure on the ink 48 contained within the ink chamber 32, which causes an ink droplet 48' to be expelled through the nozzle 47. Then, the ink 48 flows through the ink channel 34 from the manifold 36 due to surface tension of the ink 48 contacting the air to refill the ink chamber 32.

A conventional monolithic ink-jet printhead configured as above has an advantage in that the silicon substrate 30 is formed integrally with the nozzle plate 40 thereby simplifying the manufacturing process and eliminating the chance of misalignment. Another advantage is that the nozzle 47, the ink chamber 32, the ink channel 34, and the manifold 36 are arranged vertically to increase the density of nozzles 47 as compared with the ink-jet printhead of FIG. 1A.

In the conventional monolithic ink-jet printhead shown in FIGS. 2A and 2B, the material layers 41, 42, and 43 disposed around the heater 45 are made from low heat conductive insulating materials, such as an oxide or a nitride, to provide electrical insulation. Thus, a significant time must elapse for the heater 45, the ink 48 in the ink chamber 32, and the nozzle guide 44, all of which are heated for ejection of the ink 48, to sufficiently cool down and return to an initial state, thereby making it difficult to increase the operating frequency of the printhead to a sufficient level.

Another drawback of the conventional ink-jet printhead is that there is a restriction on the thickness of the material layers 41, 42, and 43 of the nozzle plate 40 since they are formed by a chemical vapor deposition (CVD) process. That is, since the nozzle plate 40 has a thickness as small as about 5 μm, it is difficult to secure a sufficient length of the nozzle 47. A small length of the nozzle 47 not only decreases the directionality of the ink droplet 48' ejected but also prohibits stable high speed printing since a meniscus in the surface of the ink 48, which cannot be formed in the nozzle 47 after ejection of the ink droplet 48', moves into the ink chamber 32. In an effort to solve these problems, the conventional ink-jet printhead has the nozzle guide 44 formed along the edge of the nozzle 47. However, if the nozzle guide 44 is too long, this not only makes it difficult to form the ink chamber 32 by etching the substrate 30 but also restricts expansion of the bubbles 49. Thus, use of the nozzle guide 44 causes a restriction on sufficiently providing the length of the nozzle 47.

Furthermore, in the conventional ink-jet printhead, an outlet of the nozzle 47 has a curved edge instead of a sharp edge. This shape decreases the ejection performance of the ink droplet 48' and makes the outer surface of the nozzle plate 40 vulnerable to becoming wet with the ink 48.

FIGS. 3 and 4 illustrate alternate examples of conventional thermally driven ink-jet printheads. Referring to FIG. 3, heater elements 51 are located on a substrate 50, and a passivation layer 52 is formed over the heater elements 51. An ink chamber 53 defined by a barrier wall 54 is constructed on the substrate 50, on top of which is an orifice plate 56 having a plurality of orifices 57. An ink feed hole 55 for supplying ink to the ink chamber 53 is formed by penetrating the substrate 50. The ink-jet printhead configured above has an advantage in that it has an integrated overall structure by forming the barrier wall 54 and the orifice plate 56 by metallic plating. However, since the ink-jet printhead has the ink chamber 53 constructed atop the substrate 50 and defined by the barrier wall 54 and uses a top-shooting ejection mechanism by locating the heater elements 51 under the ink chamber 53, it is different from an ink-jet printhead according to the present invention, which will be described later, in terms of structure, ink ejection mechanism, and manufacturing method.

FIG. 4 illustrates a conventional orifice plate of an ink-jet printhead. Referring to FIG. 4, an orifice plate 60 has a composite structure comprised of two metal layers 61 and 62 and is bonded to a substrate having heater elements located thereon after separate manufacturing. Thus, it differs from a monolithic ink-jet printhead according to the present invention.

SUMMARY OF THE INVENTION

It is a feature of an embodiment of the present invention to provide a monolithic ink-jet printhead capable of operating at a high frequency by including a nozzle plate having a heat dissipating layer made of a metal.

It is another feature of an embodiment of the present invention to provide a method of manufacturing the monolithic ink-jet printhead.

According to a feature of the present invention, there is provided a monolithic ink-jet printhead, including a substrate having an ink chamber to be supplied with ink to be ejected on a front surface thereof, a manifold for supplying ink to the ink chamber on a rear surface thereof, and an ink channel in communication with the ink chamber and the manifold, a nozzle plate including a plurality of passivation layers stacked on the substrate and a heat dissipating layer overlying the plurality of passivation layers, the nozzle plate having a nozzle penetrating the nozzle plate so that ink ejected from the ink chamber is ejected through the nozzle, a heater formed between adjacent passivation layers of the plurality of passivation layers of the nozzle plate and located above the ink chamber for heating the ink to be supplied within the ink chamber, and a conductor provided between adjacent passivation layers of the plurality of passivation layers of the nozzle plate, the conductor being electrically connected to the heater for applying current across the heater, wherein the heat dissipating layer is made of a thermally conductive metal for dissipating heat from the heater.

Preferably, the plurality of passivation layers includes first through third passivation layers sequentially stacked on the substrate, the heater is formed between the first and second passivation layers, and the conductor is located between the second and third passivation layers.

The heat dissipating layer may be made of nickel, copper, or gold by electroplating to a thickness of 10–100 μm. The nozzle plate may have a heat conductive layer located above the ink chamber, the heat conductive layer being insulated from the heater and conductor and contacting the substrate and heat dissipating layer.

The conductor and heat conductive layer may be made of the same metal and located on the same passivation layer. In this case, the conductor and the heat conductive layer are made of aluminum, aluminum alloy, gold, or silver. Furthermore, an insulating layer may be interposed between the conductor and the heat-conductive layer.

An upper part of the nozzle is formed in the heat dissipating layer and may have a pillar shape or a cross-sectional area that decreases toward an exit at an upper surface of the nozzle.

A lower part of the nozzle may be formed by penetrating the plurality of passivation layers sequentially stacked on the substrate in such a way to connect the upper part of the nozzle with the ink chamber. The heater may be centered around the nozzle. A cross-sectional shape of the ink channel may be circular, oval, or polygonal.

Furthermore, a nozzle guide extending into the ink chamber can be formed along edges of the lower part of the nozzle.

A printhead according to an embodiment of the present invention having a heat dissipating layer made of a thick metal improves heat sinking capability, thereby increasing the ink ejection performance and the operating frequency. Furthermore, a sufficient length of nozzle can be provided to maintain a meniscus within the nozzle. This capability allows a stable ink refill operation while increasing the directionality of an ink droplet being ejected.

According to another feature of the present invention, there is provided a method of manufacturing a monolithic ink-jet printhead including (a) preparing a substrate, (b) stacking a plurality of passivation layers on the substrate and forming a heater and a conductor connected to the heater between adjacent passivation layers of the plurality of passivation layers, (c) forming a heat dissipating layer made of a metal over the plurality of passivation layers and forming a nozzle in such a way to penetrate the plurality of passivation layers and heat dissipating layer to construct a nozzle plate including the passivation layers and heat dissipating layer integrally with the substrate, (d) etching the substrate exposed through the nozzle to form an ink chamber to be supplied with ink, (e) etching a rear surface of the substrate to form a manifold for supplying ink, and (f)

forming an ink channel by etching the substrate so that it penetrates the substrate between the manifold and the ink chamber.

In (a), the substrate may be made of a silicon wafer. Step (b) may include: forming a first passivation layer on a front surface of the substrate; forming the heater on top of the first passivation layer; forming a second passivation layer on the first passivation layer and the heater; forming the conductor on top of the second passivation layer; and forming a third passivation layer on the second passivation layer and the conductor. Furthermore, in (b), a heater conductive layer located above the ink chamber is formed between the passivation layers, whereby the heat conductive layer is insulated from the heater and conductor and contacts the substrate and heat dissipating layer.

The heat conductive layer and the conductor can be simultaneously formed from the same metal, preferably, aluminum, aluminum alloy, gold, or silver.

After forming an insulating layer on the conductor, the heater conductive layer is formed on the insulating layer. In (c), the heat dissipating layer can be formed from nickel, copper, or gold by electroplating to a thickness of 10–100 μm.

Step (c) may include etching the passivation layers to form a lower nozzle; forming a first sacrificial layer in the lower nozzle; forming a seed layer for electroplating on the uppermost passivation layer and the first sacrificial layer; forming a second sacrificial layer for forming an upper nozzle on the seed layer; forming the heat dissipating layer on the seed layer by electroplating; and removing the second sacrificial layer, the seed layer underlying the second sacrificial layer, and the first sacrificial layer and forming a complete nozzle consisting of the lower and upper nozzles.

Alternatively, (c) may include etching the passivation layers to form a lower nozzle; forming a seed layer for electroplating on the uppermost passivation layer and within the lower nozzle; forming a first sacrificial layer on the seed layer within the lower nozzle and forming a second sacrificial layer for forming an upper nozzle on the first sacrificial layer; forming the heat dissipating layer on the seed layer by electroplating; and removing the second sacrificial layer, the first sacrificial layer, and the seed layer underlying the first sacrificial layer, and forming a complete nozzle consisting of the lower and upper nozzles. The first and second sacrificial layers may be formed integrally with each other.

The lower nozzle may be formed by dry etching the passivation layers using reactive ion etching (RIE). The first and second sacrificial layers may be made from a photoresist or photosensitive polymer. The seed layer may be formed by depositing one metal selected from the group consisting of copper, chrome, titanium, gold, and nickel. The seed layer may be comprised of a plurality of metal layers, each of which is formed by depositing copper, chrome, titanium, gold, or nickel.

Furthermore, forming the lower nozzle may include anisotropically etching the passivation layers and the substrate to form a hole of a predetermined depth; depositing a predetermined material layer within the hole; and etching the material layer formed at a bottom of the hole to expose the substrate while at the same time forming a nozzle guide made of the material layer for defining the lower nozzle along a sidewall of the hole.

After forming the heat dissipating layer, the method may further include planarizing the surface of the heat dissipating layer by chemical mechanical polishing (CMP).

In (d), the substrate exposed through the nozzle may be dry etched isotropically to form the ink chamber having a predetermined space filled with ink. In (f), the substrate is dry etched by reactive ion etching (RIE) from the rear surface of the substrate on which the manifold has been formed to form the ink channel. Alternatively, in (f), the substrate formed at the bottom of the ink chamber may be dry etched by RIE from the front surface of the substrate through the nozzle to form the ink channel.

Since the nozzle plate having the nozzle is formed integrally with the substrate having the ink chamber and the ink channel formed thereon, the manufacturing method presented in this invention makes it possible to realize an ink-jet printhead on a single wafer in a single process.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF THE INVENTION

Figure 1A:
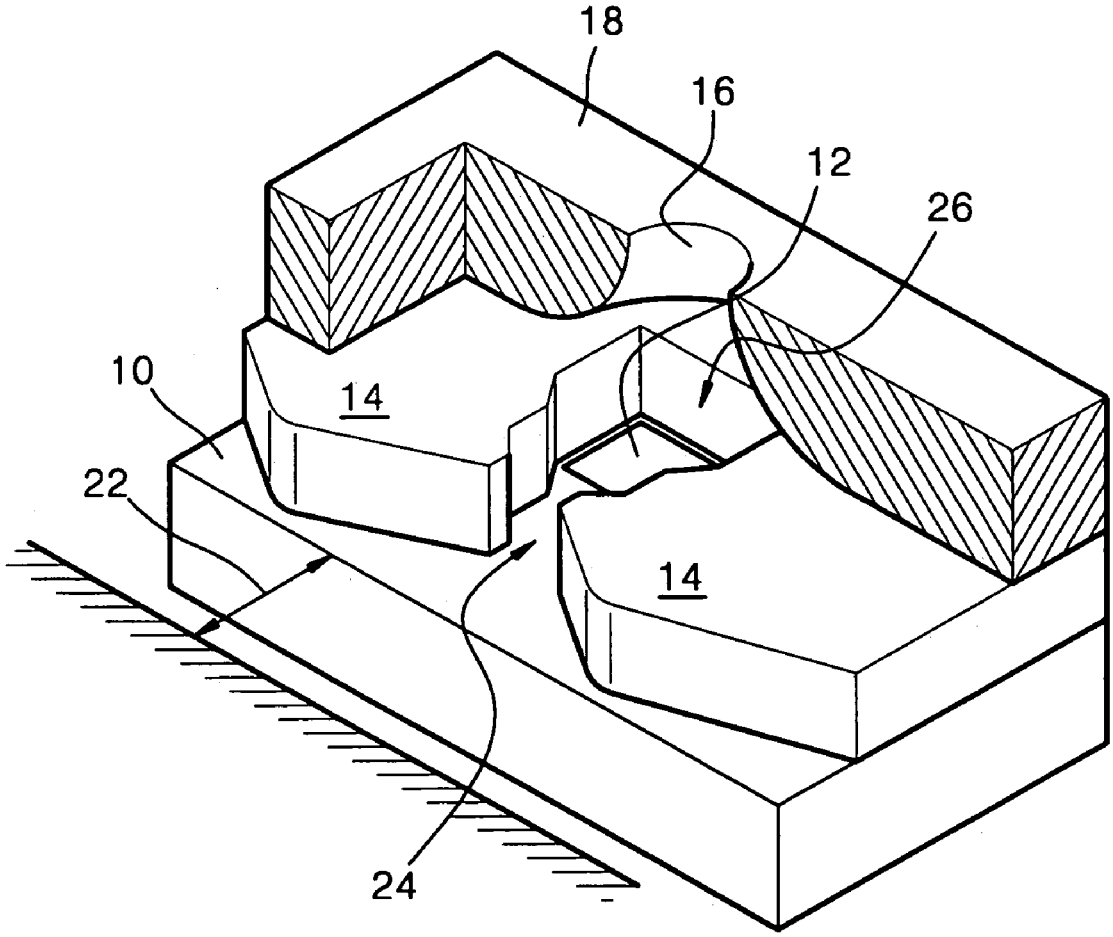
FIG. 1A (PRIOR ART)
FIGS. 1A and 1B illustrate a partial cross-sectional perspective view of a conventional thermally driven ink-jet printhead and a cross-sectional view for explaining a process of ejecting an ink droplet, respectively.
Figure 1B:
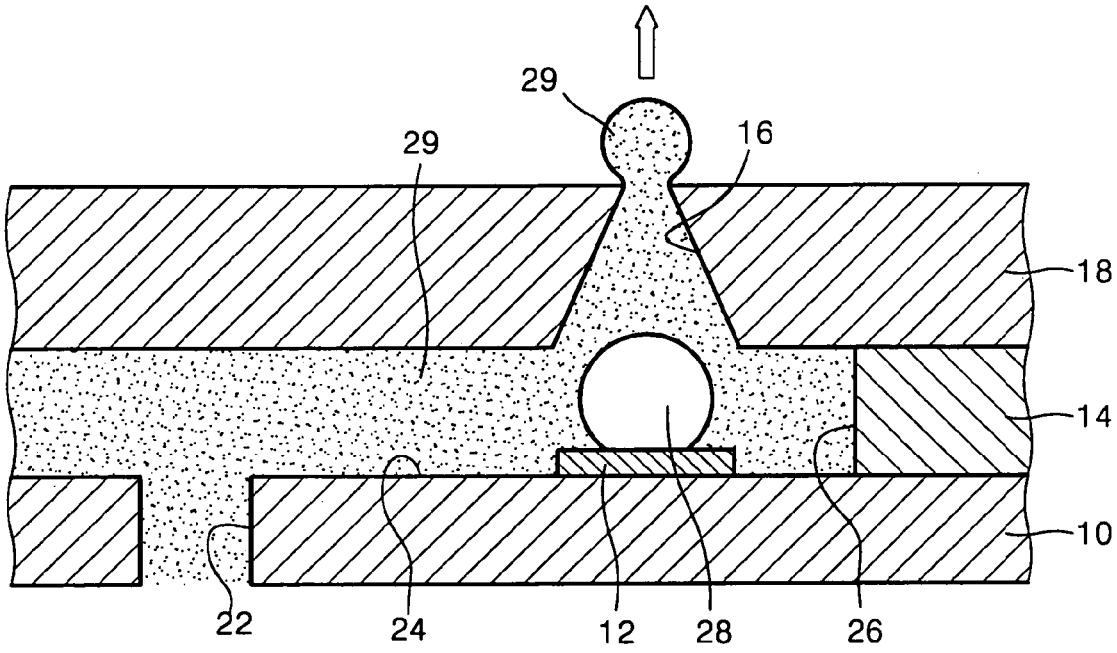
FIG. 1B (PRIOR ART)
Figure 2A:
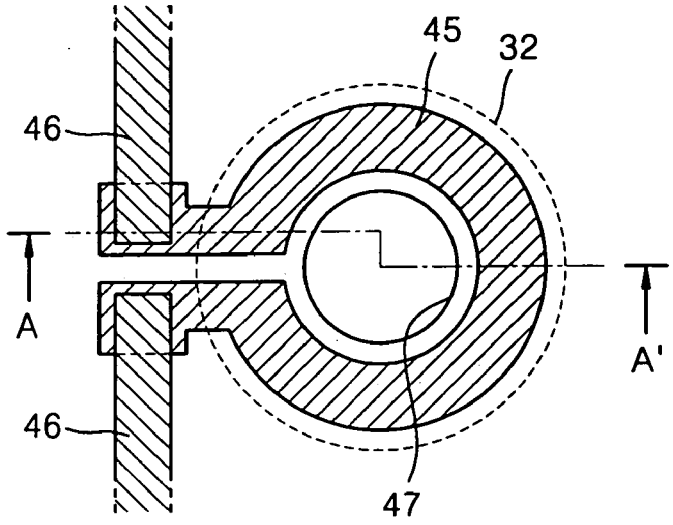
FIG. 2A (PRIOR ART)
FIGS. 2A and 2B illustrate a plan view showing an example of a conventional monolithic ink-jet printhead and a vertical cross-sectional view taken along line A–A' of FIG. 2A, respectively.
Figure 2B:
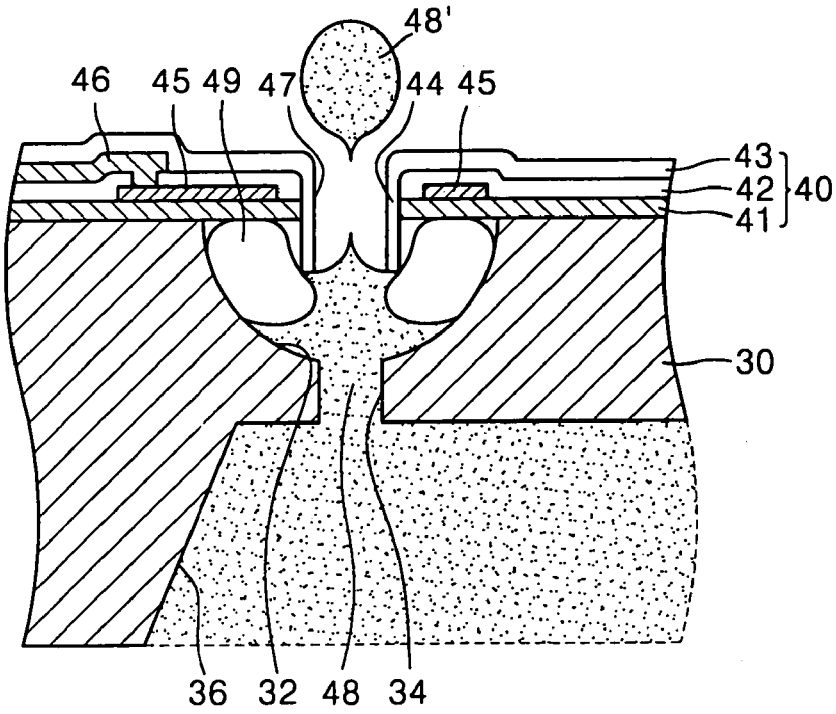
FIG. 2B (PRIOR ART)
Figure 3:
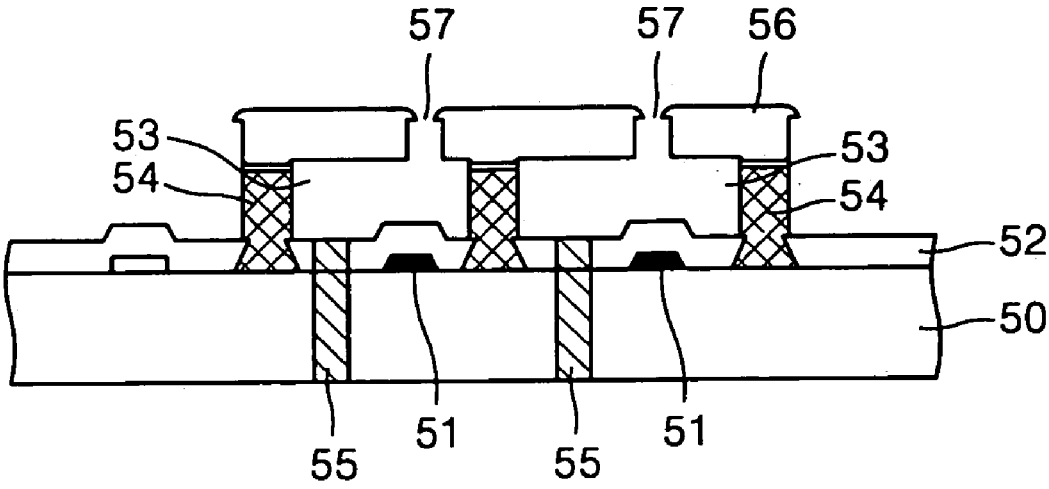
FIG. 3 (PRIOR ART)
FIGS. 3 and 4 illustrate further examples of conventional thermally driven ink-jet printheads.
Figure 4:
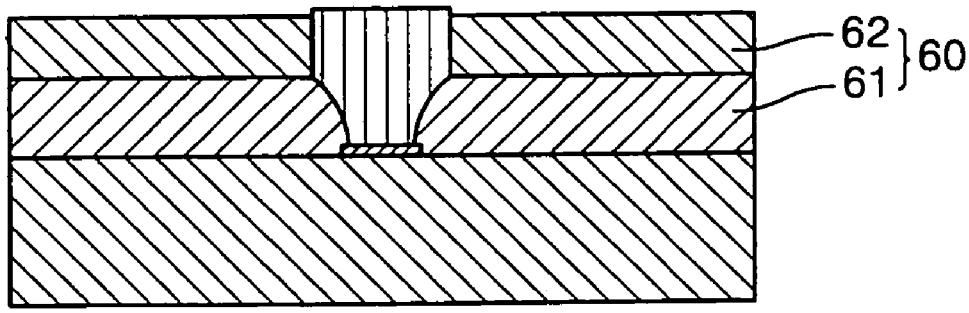
FIG. 4 (PRIOR ART)

Korean Patent Application No. 2002-62257, filed on Oct. 12, 2002, and entitled: "Monolithic Ink-Jet Printhead Having a Metal Nozzle Plate and Manufacturing Method Thereof," is incorporated by reference herein in its entirety.

The present invention will now be described more fully hereinafter with reference to the accompanying drawings, in which preferred embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions and the sizes of components may be exaggerated for clarity. It will also be understood that when a layer is referred to as being "on" another layer or substrate, it can be directly on the other layer or substrate, or intervening layers may also be present. Like reference numerals refer to like elements throughout.

Figure 5:
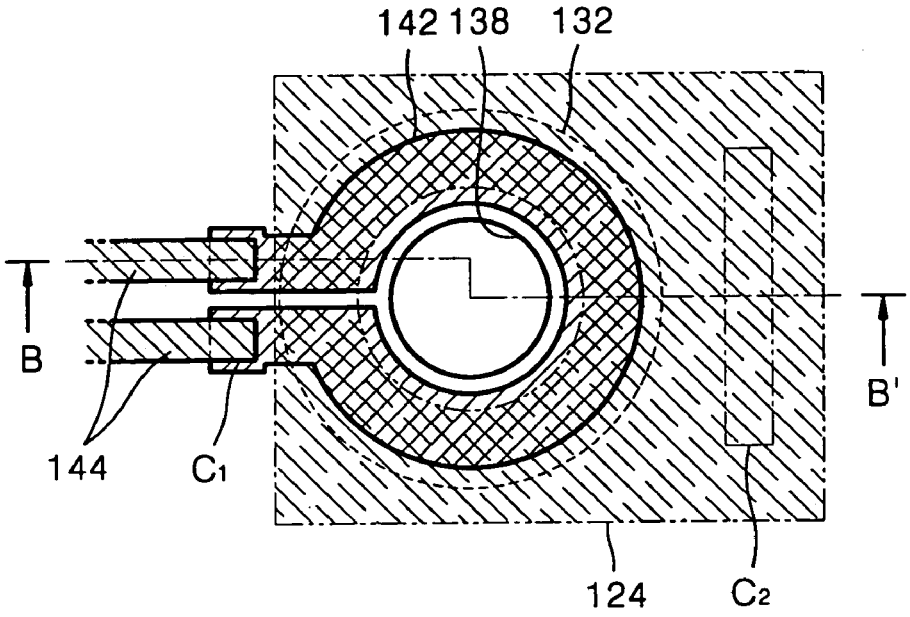
FIG. 5 illustrates a planar structure of a monolithic ink-jet printhead according to a preferred embodiment of the present invention.
Figure 6:
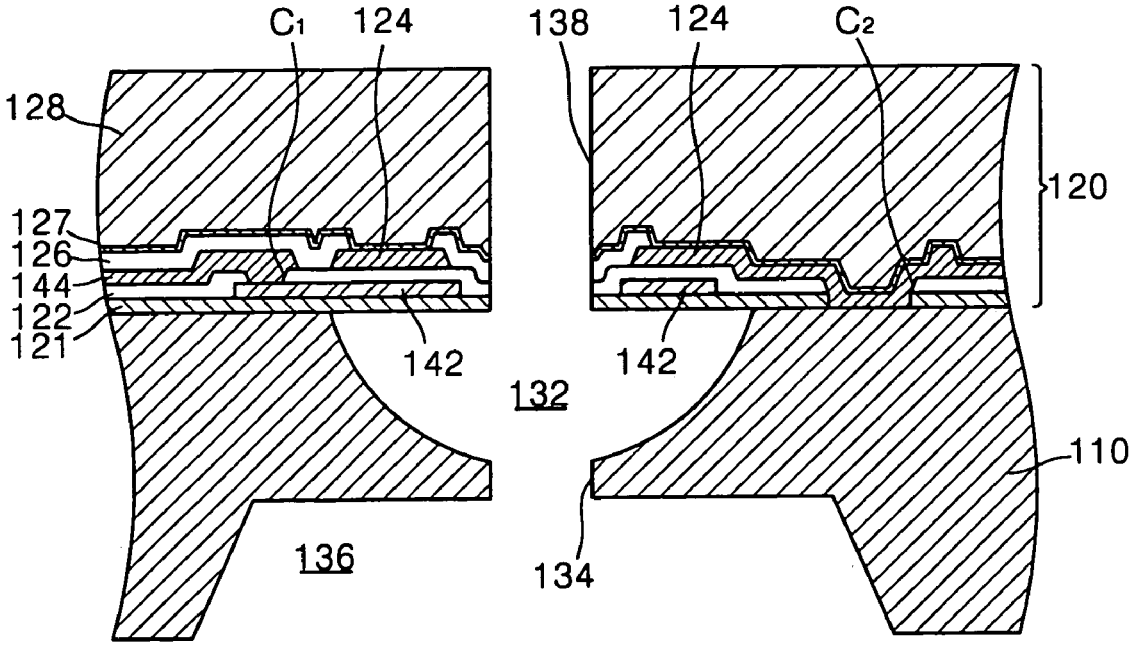
FIG. 6 illustrates a vertical cross-sectional view of the ink-jet printhead of the present invention taken along line B–B' of FIG. 5.

FIG. 5 illustrates a planar structure of a monolithic ink-jet printhead according to a preferred embodiment of the present invention. FIG. 6 illustrates a vertical cross-sectional view of the ink-jet printhead of FIG. 5 taken along line B–B' of FIG. 5. Referring to FIGS. 5 and 6, while an ink chamber 132 to be supplied with ink to be ejected is formed to a predetermined depth on a front surface, i.e., an upper surface, of a substrate 110, a manifold 136 for supplying ink to the ink chamber 132 is formed on a rear surface, i.e., a lower surface, of the substrate 110. Here, a silicon wafer widely used to manufacture integrated circuits (ICs) may be used for the substrate 110. The manifold 136 is formed under the ink chamber 132 and connected to an ink reservoir (not shown).

Although only a unit structure of the ink-jet printhead has been shown in the drawings, a plurality of ink chambers 132 are arranged on the manifold 136 in one or two rows, or in three or more rows to achieve higher resolution in an ink-jet printhead fabricated using chips.

An ink channel 134 in communication with the ink chamber 132 and the manifold 136 is formed between them by perpendicularly penetrating the substrate 110. The ink channel 134 is formed at a central portion of a bottom surface of the ink chamber 132. A cross-sectional shape is preferably circular. However, the ink channel 134 may have various cross-sectional shapes such as oval or polygonal, and may be formed at any other location that provides communication between the ink chamber 132 and the manifold 136 by perpendicularly penetrating the substrate 110.

A nozzle plate 120 is formed on the substrate 110 having the ink chamber 132, the ink channel 134, and the manifold 136 formed thereon. The nozzle plate 120 forming an upper wall of the ink chamber 132 has a nozzle 138, through which ink is ejected, formed at a location corresponding to a center of the ink chamber 132 by perpendicularly penetrating the nozzle plate 120. While the nozzle 138 preferably has a circular cross-sectional shape, it may have other cross-sectional shapes such as an oval or a polygonal shape.

The nozzle plate 120 is comprised of a plurality of material layers stacked on the substrate 110. The plurality of material layers consist of first and second passivation layers 121 and 122, a heat conductive layer 124, a third passivation layer 126, and a heat dissipating layer 128 made of a metal. A heater 142 is disposed between the first and second passivation layers 121 and 122, and a conductor 144 is provided between the second and third passivation layers 122 and 126.

The first passivation layer 121, the lowermost layer from among the plurality of material layers forming the nozzle plate 120, is formed on an upper surface of the substrate 110. The first passivation layer 121 provides electrical insulation between the overlying heater 142 and underlying substrate 110 as well as protection of the heater 142. The first passivation layer 121 may be made of silicon oxide or silicon nitride.

The heater 142 overlying the first passivation layer 121 and located above the ink chamber 132 for heating ink contained in the ink chamber 132 is centered around the nozzle 138. The heater 142 consists of a resistive heating material, such as polysilicon doped with impurities, tantanium-aluminum alloy, tantalum nitride, titanium nitride, and tungsten silicide. The heater 142 may have the shape of a circular ring centered around the nozzle 138 as shown in FIG. 5, or other shapes such as rectangular or hexagonal.

The second passivation layer 122 is formed on the first passivation layer 121 and the heater 142 for providing insulation between the overlying heat conductive layer 124 and the underlying heater 142 as well as protection of the heater 142. Similarly to the first passivation layer 121, the second passivation layer 122 may be made of silicon nitride or silicon oxide.

The conductor 144 electrically connected to the heater 142 for applying a current pulse across the heater 142 is formed on the second passivation layer 122. While a first end of the conductor 144 is coupled to the heater 142 through a first contact hole $C_1$ formed in the second passivation layer 122, a second end is electrically connected to a bonding pad (not shown). The conductor 144 may be made of a highly conductive metal such as aluminum, aluminum alloy, gold, or silver.

The heat conductive layer 124 may overlie the second passivation layer 122. The heat conductive layer 124 functions to conduct heat from the heater 142 to the substrate 110 and the heat dissipating layer 128 which will be described later. The heat conductive layer 124 is preferably formed as widely as possible to cover the ink chamber 132 and the heater 142 entirely. The heat conductive layer 124 needs to be separated from the conductor 144 by a predetermined distance for insulation purpose. The insulation between the heat conductive layer 124 and the conductor 144 can be achieved by the second passivation layer 122 interposed therebetween. Furthermore, the heat conductive layer 124 contacts the top surface of the substrate 110 through a second contact hole $C_2$ penetrating the first and second passivation layers 121 and 122.

The heat conductive layer 124 is made of a metal having good conductivity. When both heat conductive layer 124 and the conductor 144 are formed atop the second passivation layer 122, the heat conductive layer 124 may be made of the same material as the conductor 144, such as aluminum, aluminum alloy, gold, or silver. If the heat conductive layer 124 is to be formed thicker than the conductor 144 or made of material different from that of the conductor 144, an insulating layer (not shown) may be interposed between the conductor 144 and the heat conductive layer 124.

The third passivation layer 126 overlying the conductor 144 and the second passivation layer 122 may be made of tetraethylorthosilicate (TEOS) oxide or silicon oxide. It is desirable to avoid forming the third passivation layer 126 over the heat conductive layer 124 to avoid contacting the heat conductive layer 124 and the heat dissipating layer 128.

The heat dissipating layer 128, the uppermost layer from among the plurality of material layers forming the nozzle plate 120, is made of a metal having high thermal conductivity, such as nickel, copper, or gold. The heat dissipating layer 128 is formed to a thickness of between about 10–100 μm by electroplating the metal on the third passivation layer 126 and the heat conductive layer 124. To accomplish this formation, a seed layer 127 for electroplating the metal is disposed on top of the third passivation layer 126 and the heat conductive layer 124. The seed layer 127 may be made of a metal having good electric conductivity such as copper, chrome, titanium, gold or nickel.

Since the heat dissipating layer 128 made of a metal as described above is formed by an electroplating process, it can be formed relatively thick and integrally with other components of the ink-jet printhead, thus providing effective heat sinking. As described above, a deposition process makes it difficult to form a thick material layer, so the deposition process must be repeated several times.

The heat dissipating layer 128 functions to dissipate the heat from the heater 142 or from around the heater 142. That is, the heat residing in or around the heater 142 after ink ejection is guided to the substrate 110 and the heat dissipating layer 128 via the heat conductive layer 124 and then dissipates. This allows quick heat dissipation after ink ejection and lowers the temperature near the nozzle 138, thereby providing a stable printing at a high operating frequency.

Temperature differences near an edge of a nozzle exit between initial state and operating state in nozzle plates having various structures are shown in Table 1 below. That is, the following data shows how many degrees the temperature near the edge of the nozzle exit rises when applying a current pulse at a frequency of 20 kHz and changing from an initial state to a quasi-steady state.

TABLE 1

| | Case | | | |
|---|---|---|---|---|
| | 1 (Present Invention) | 2 | 3 | 4 (Prior Art) |
| Increased temperature (° C.) | 7.4 | 30.1 | 38.4 | 197.4 |

In Table 1, Case 1 pertains to a nozzle plate having a heat dissipating layer and a heat conductive layer, both of which are made of a metal, according to a preferred embodiment of the present invention; Case 2 is an example of a nozzle plate having a heat conductive layer and a heat dissipating layer made of a polymer; and Cases 3 and 4 are examples of a nozzle plate having only a heat conductive layer and a conventional nozzle plate.

As evident from Table 1, the nozzle plate of an embodiment of the present invention (Case 1) shows a very little temperature increase near the edge of the nozzle exit as compared to a conventional nozzle plate (Case 4). Furthermore, the heat dissipating layer (Case 1) made of a metal, as in an embodiment of the present invention, provides excellent heat sinking capability over the heat dissipating layer made of polymer (Case 2).

Meanwhile, a relatively thick heat dissipating layer 128, as described above, makes it possible to sufficiently provide the length of the nozzle 138, which enables stable high speed printing while improving the directionality of an ink droplet being ejected through the nozzle 138. That is, an ink droplet can be ejected in a direction exactly perpendicular to the substrate 110. Furthermore, since an upper part of the nozzle 138 is formed in the heat dissipating layer 128 made of a metal, the exit of the nozzle 138 can be formed to have a sharp edge. This improves the ejection performance of an ink droplet while eliminating the problem of an outer surface of the nozzle plate 120 becoming wet with ink.

Figure 7:
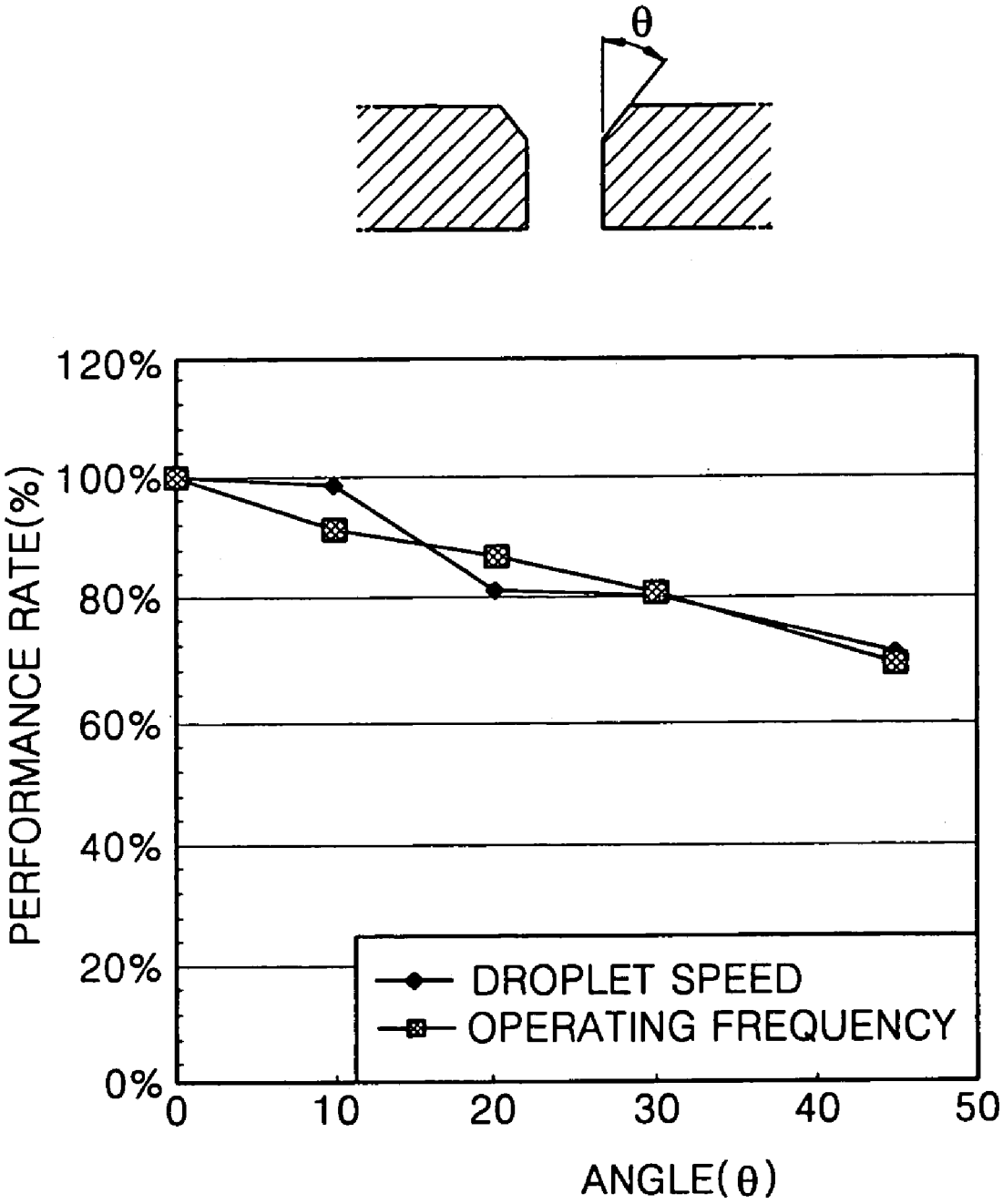
FIG. 7 is a graph showing the ejection performance of an ink droplet with respect to a change in the chamfer angle of a nozzle.

FIG. 7 is a graph showing the ejection performance of an ink droplet with respect to a change in the chamfer angle (θ) of the nozzle 138. In the graph of FIG. 7, performance rates indicated along the ordinate axis represent the percentages (%) of droplet speed and operating frequency, respectively, versus the chamfer angle (θ) of the nozzle. As evident in the graph of FIG. 7, as the edge of the nozzle exit becomes sharper, i.e., the chamfer angle of the nozzle decreases, the droplet speed and the operating frequency increase, thereby improving the ejection performance of an ink droplet.

Figure 8A:
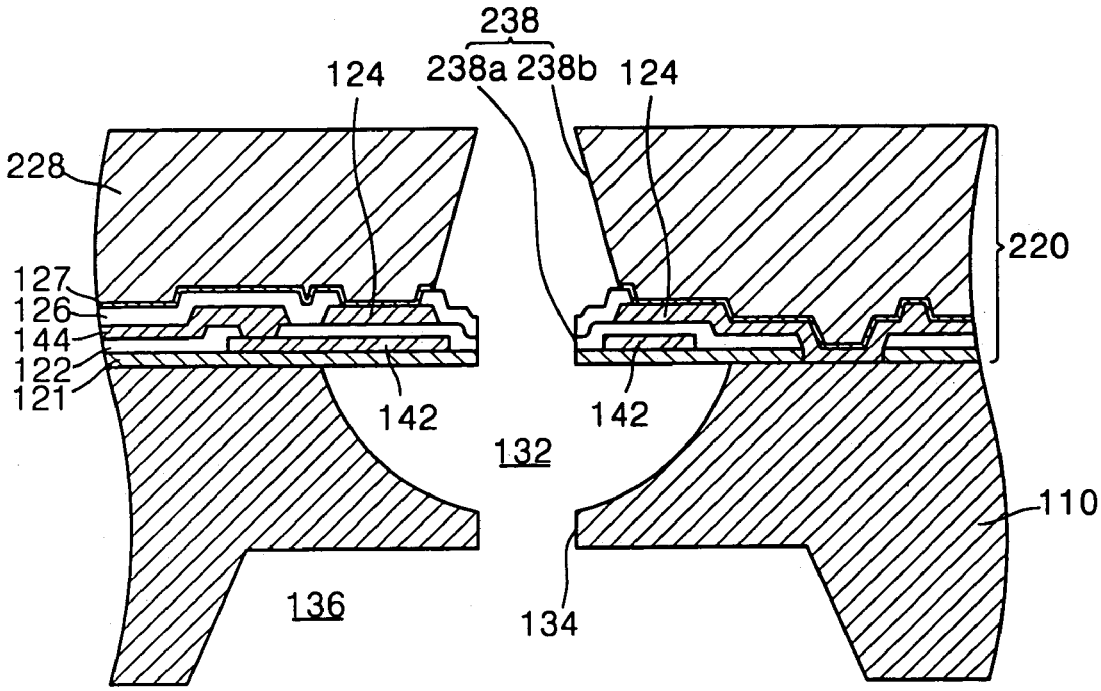
FIGS. 8A and 8B illustrate vertical cross-sectional views of modified examples of the nozzle plate shown in FIG. 6.
Figure 8B:
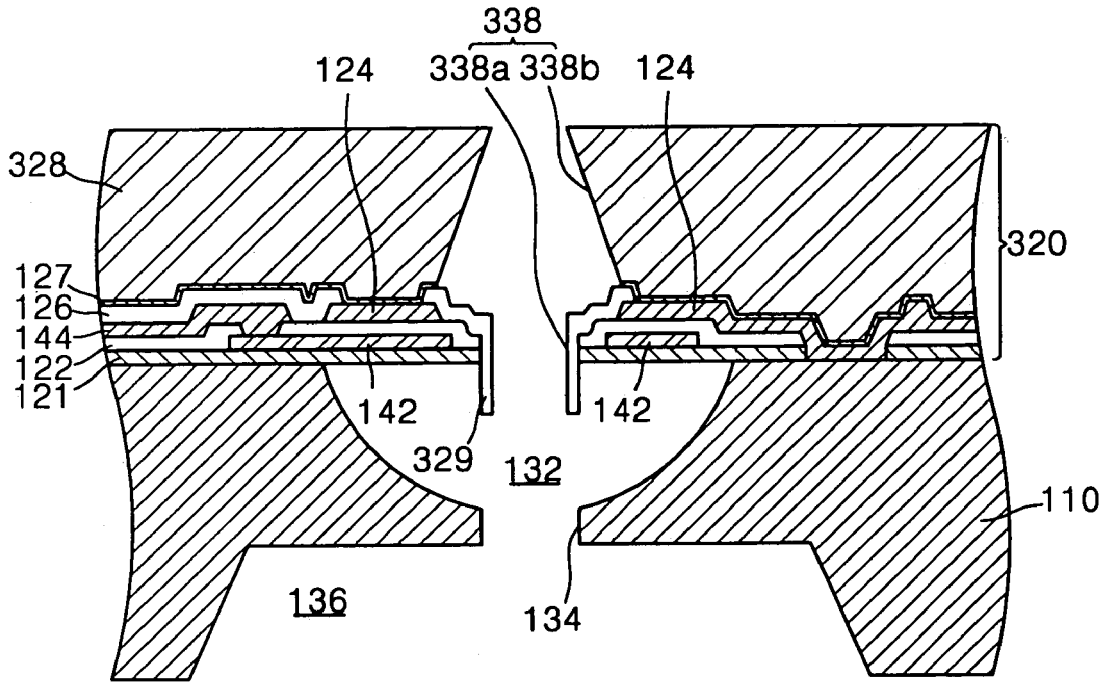

FIGS. 8A and 8B illustrate vertical cross-sectional views showing modified examples of the nozzle plate shown in FIG. 6. Referring to FIG. 8A, while a lower part 238*a* of a nozzle 238 is formed in a pillar shape in the first through third passivation layers 121, 122, and 126 of a nozzle plate 220, an upper part 238*b* of the nozzle 238 is formed in a heat dissipating layer 228. The upper part 238*b* is tapered so that a cross-sectional area decreases toward the exit thereof. If the upper part 238*b* has a tapered shape as described above, a meniscus in the ink surface is more quickly stabilized after ink ejection.

Referring to FIG. 8B, a nozzle 338 formed in a nozzle plate 320 consists of a lower nozzle 338*a* formed in the shape of a pillar in the first through third passivation layers 121, 122, and 126, and an upper nozzle 338*b* formed in a tapered shape in a heat dissipating layer 328. A nozzle guide 329 extends a predetermined length down the lower nozzle 338*a* and into the ink chamber 132. Thus, the nozzle guide 329 lengthens the lower nozzle 338*a*. Similarly, the nozzle guide 329 can be formed in the cylindrical nozzle 138 of the nozzle plate 120 shown in FIG. 6.

In this way, the nozzle guide 329 acts to lengthen the overall length of the nozzle 338, thereby improving the directionality of an ink droplet being ejected through the nozzle 338. However, this may not only limit the expansion of bubbles but may also complicate the manufacturing process.

An ink ejection mechanism for an ink-jet printhead according to the present invention will now be described with references to FIGS. 9A–9C based on an ink-jet printhead having the nozzle plate 220 shown in FIG. 8A.

Figure 9A:
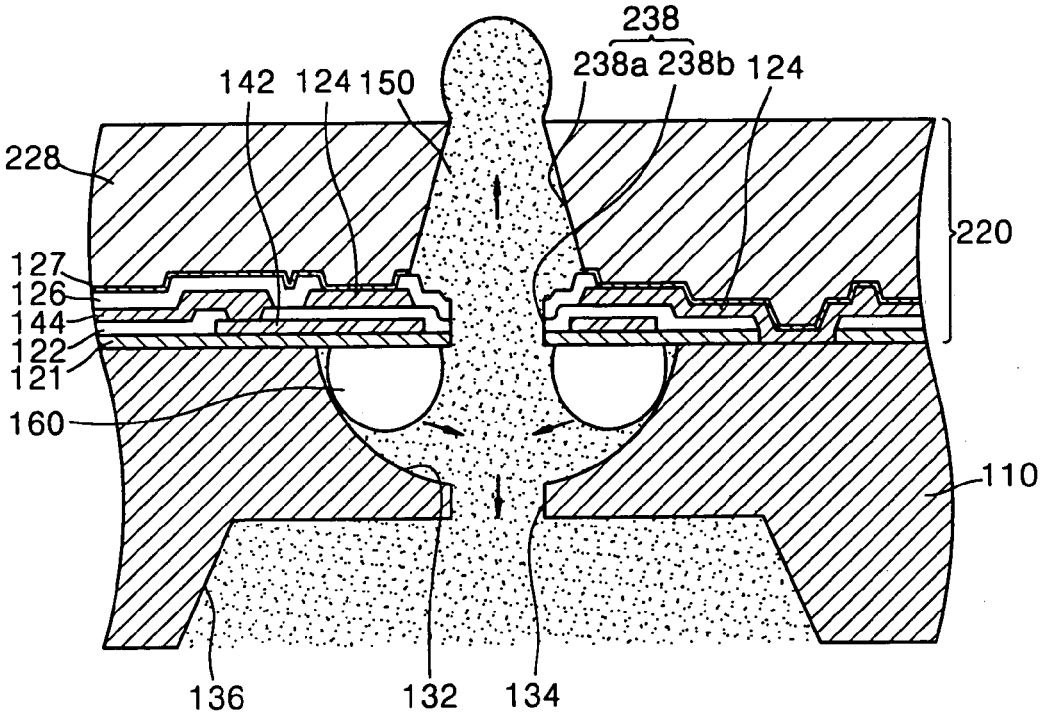
FIGS. 9A through 9C illustrate an ink ejection mechanism in an ink-jet printhead according to an embodiment of the present invention.

Referring to FIG. 9A, if a current pulse is applied to the heater 142 through the conductor 144 when the ink chamber 132 and the nozzle 238 are filled with ink 150, heat is generated by the heater 142 and transmitted through the first passivation layer 121 underlying the heater 142 to the ink 150 within the ink chamber 132. The ink 150 then boils to form bubbles 160. As the bubbles 160 expand upon a continuous supply of heat, the ink 150 within the nozzle 238 is ejected out of the nozzle 238.

Figure 9B:
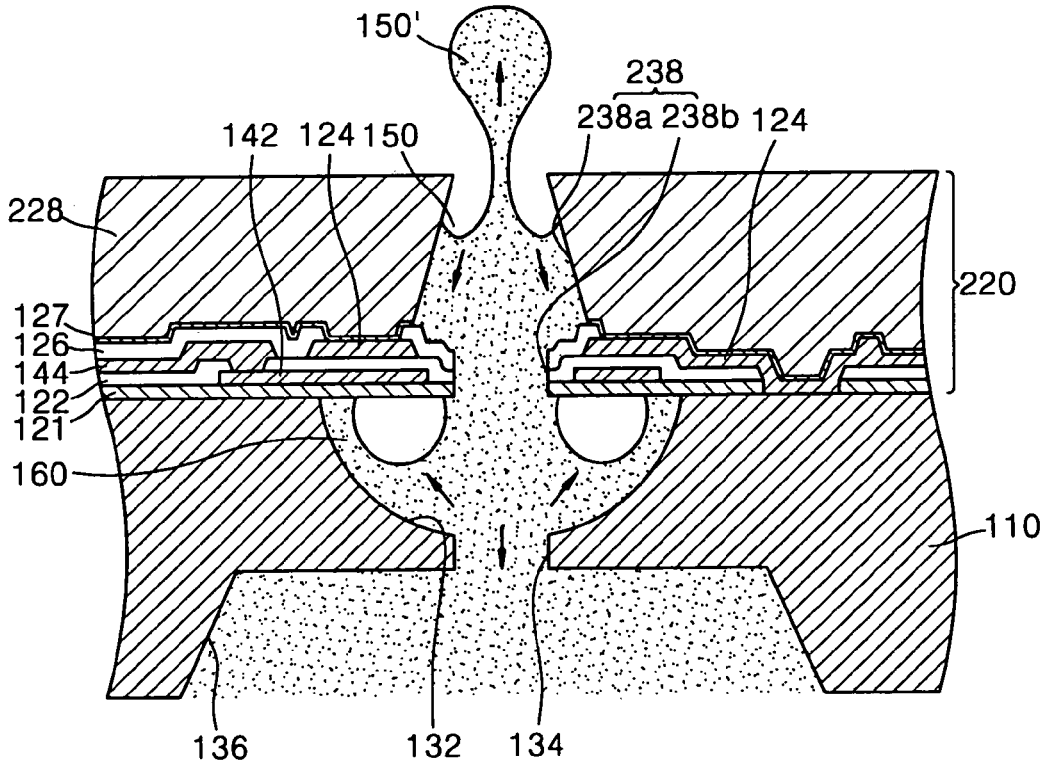

Referring to FIG. 9B, if a current pulse cuts off when the bubble 160 expands to a maximum size thereof, the bubble 160 then shrinks until it collapses completely. At this time, a negative pressure is formed in the ink chamber 132 so that the ink 150 within the nozzle 238 returns to the ink chamber 132. At the same time, a portion of the ink 150 being pushed out of the nozzle 238 is separated from the ink 150 within the nozzle 238 and ejected in the form of an ink droplet 150' due to an inertial force.

A meniscus in the surface of the ink 150 retreats toward the ink chamber 132 after ink droplet 150' separation. In this case, the nozzle 238 is sufficiently long due to the thick nozzle plate 220 so that the meniscus retreats only within the nozzle 238 and not into the ink chamber 132. Thus, this prevents air from flowing into the ink chamber 132 while quickly restoring the meniscus to an original state, thereby stably maintaining high speed ejection of the ink droplet 150'. Furthermore, since heat residing in or around the heater 142 passes through the heat conductive layer 124 and the heat dissipating layer 228 and dissipates into the substrate 110, the temperature in or around the heater 142 and nozzle 238 drops even more rapidly.

Figure 9C:
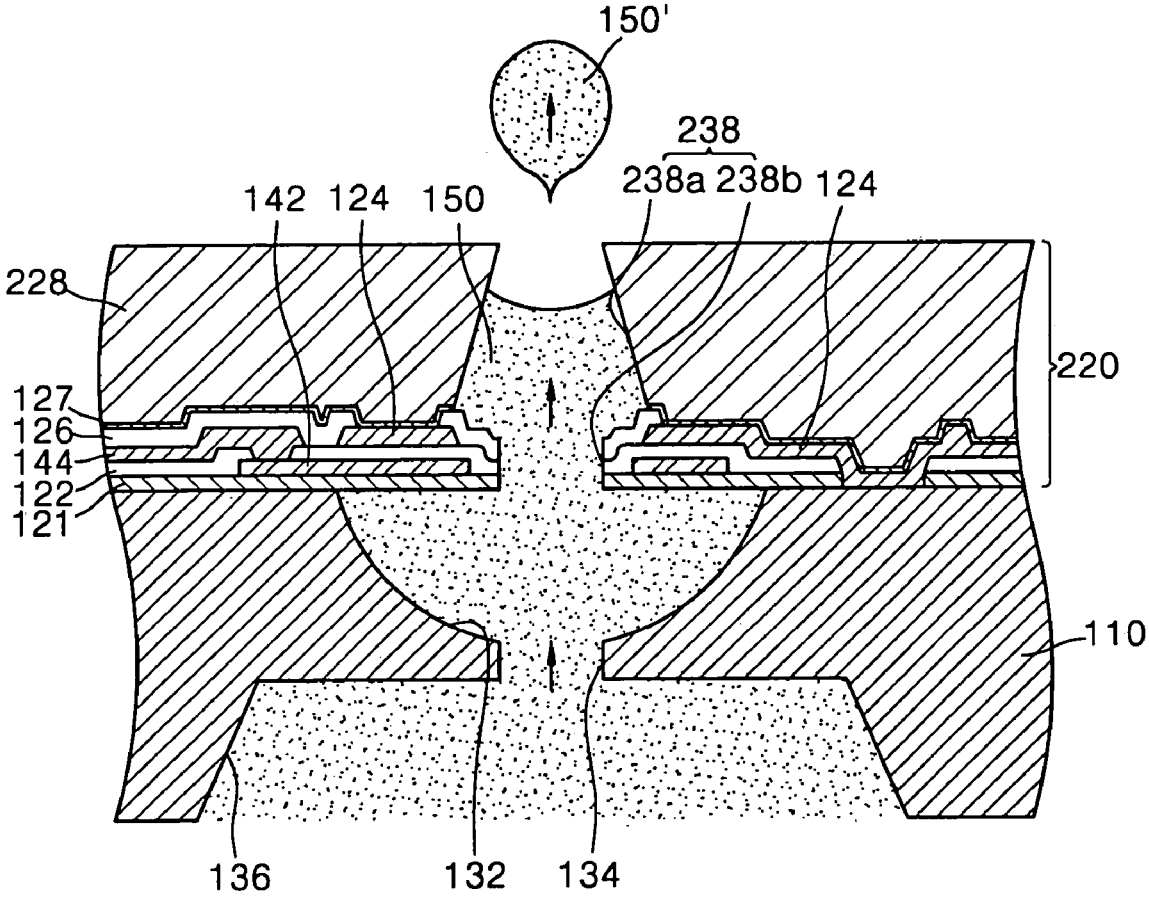

Next, referring to FIG. 9C, as the negative pressure within the ink chamber 132 disappears, the ink 150 again flows toward the exit of the nozzle 238 due to a surface tension force acting at a meniscus formed in the nozzle 238. If the upper part 238*b* of the nozzle 238 is tapered, the speed at which the ink 150 flows upward further increases. The ink 150 is then supplied through the ink channel 134 to refill the ink chamber 132. When ink refill is completed so that the printhead returns to an initial state, the ink ejection mechanism is repeated. During the above process, the printhead can thermally recover the original state thereof more quickly because of heat dissipation through the heat conductive layer 124 and heat dissipating layer 228.

A method of manufacturing a monolithic ink-jet printhead configured above according to a preferred embodiment of the present invention will now be described.

FIGS. 10–20 illustrate cross-sectional views for explaining stages in a method of manufacturing of a monolithic ink-jet printhead having the nozzle plate shown in FIG. 8A according to a preferred embodiment of the present invention. FIG. 21 illustrates an alternate method of forming a seed layer and a sacrificial layer. Meanwhile, a method of manufacturing the ink-jet printhead having the nozzle plate shown in FIG. 6 is the same as described below except for the shape of the nozzle formed in the nozzle plate.

Figure 10:
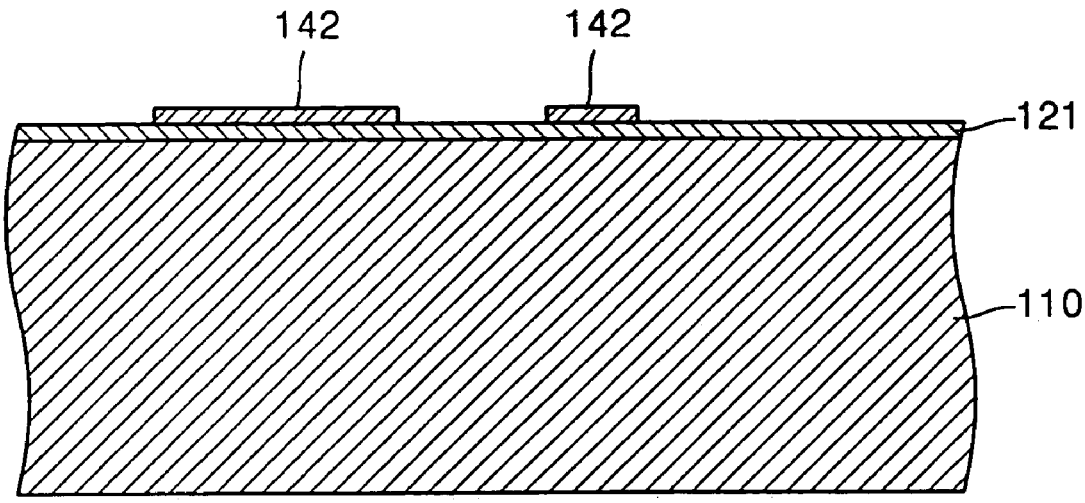
FIGS. 10 through 20 illustrate cross-sectional views for explaining a method of manufacturing an ink-jet printhead having the nozzle plate shown in FIG. 8A according to a preferred embodiment of the present invention.

Referring to FIG. 10, a silicon wafer used for the substrate 110 has been processed to have a thickness of approximately 300–500 μm. The silicon wafer is widely used for manufacturing semiconductor devices and effective for mass production.

While FIG. 10 shows a very small portion of the silicon wafer, the ink-jet printhead according to the present invention can be fabricated in tens to hundreds of chips on a single wafer.

The first passivation layer 121 is formed over the prepared silicon substrate 110 by depositing silicon oxide or silicon nitride. The heater 142 is then formed on the first passivation layer 121 overlying the substrate 110 by depositing a resistive heating material, such as polysilicon doped with impurities, tantalum-aluminum alloy, tantalum nitride, titanium nitride, or tungsten silicide, over the entire surface of the first passivation layer 121 to a predetermined thickness and patterning the same. Specifically, while the polysilicon doped with impurities such as phosphorus (P) contained in a source gas can be deposited by low pressure chemical vapor deposition (LPCVD) to a thickness of approximately 0.7–1 μm, tantalum-aluminum alloy, tantalum nitride, titanium nitride, or tungsten silicide may be deposited by sputtering or chemical vapor deposition (CVD) to a thickness of about 0.1–0.3 μm. The deposition thickness of the resistive heating material may be determined in a range other than that given here to have an appropriate resistance considering the width and length of the heater 142. The resistive heating material is deposited over the entire surface of the first passivation layer 121 and then patterned by a photo process using a photomask and a photoresist and an etching process using a photoresist pattern as an etch mask.

Figure 11:
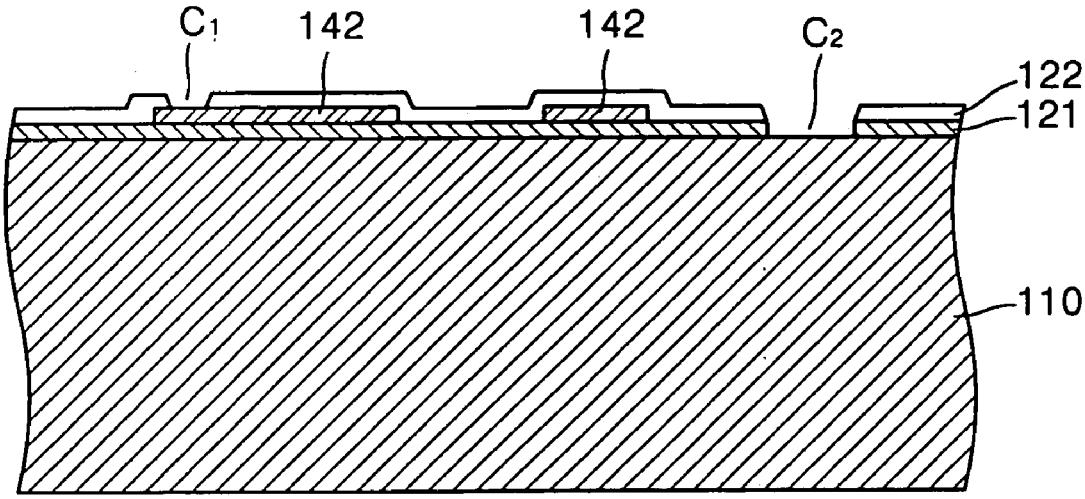

Subsequently, as shown in FIG. 11, the second passivation layer 122 is formed on the first passivation layer 121 and the heater 142 by depositing silicon oxide or silicon nitride to a thickness of about 0.5–3 μm. The second passivation layer 122 is then partially etched to form a first contact hole $C_1$ exposing a portion of the heater 142 to be coupled with the conductor 144 in a step shown in FIG. 12. In addition, the second and first passivation layers 122 and 121 are sequentially etched to form a second contact hole $C_2$ exposing a portion of the substrate 110 to contact the heat conductive layer 124 in the step also shown in FIG. 12. The first and second contact holes $C_1$ and $C_2$ can be formed simultaneously.

Figure 12:
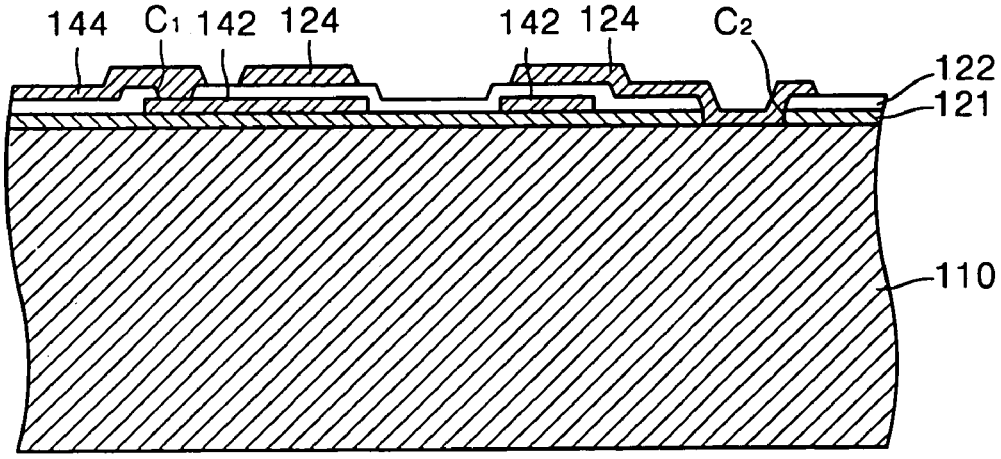

FIG. 12 shows the state in which the conductor 144 and the heat conductive layer 124 have been formed on the second passivation layer 122. Specifically, the conductor 144 and the heat conductive layer 124 can be formed at the same time by depositing a metal having excellent electric and thermal conductivity such as aluminum, aluminum alloy, gold or silver using sputtering techniques to a thickness on the order of 1 μm and patterning the same. In this case, the conductor 144 and the heat conductive layer 124 are formed insulated from each other, so that the conductor 144 is coupled to the heater 142 through the first contact hole $C_1$ and the heat conductive layer 124 contacts the substrate 110 through the second contact hole $C_2$.

Meanwhile, if the heat conductive layer 124 is to be formed thicker than the conductor 144 or if the heat conductive layer 124 is to be made of a metal other than the metal forming the conductor 144, or to further ensure insulation between the conductor 144 and heat conductive layer 124, the heat conductive layer 124 may be formed after the formation of the conductor 144. More specifically, after forming only the first contact hole $C_1$, the conductor 144 is formed. An insulating layer (not shown) is then formed on the conductor 144 and second passivation layer 122. The insulating layer can be formed from the same material using the same method as the second passivation layer 122. The insulating layer and the second and first passivation layers 122 and 121 are then sequentially etched to form the second contact hole $C_2$. Thus, the insulating layer is interposed between the conductor 144 and the heat conductive layer 124.

Figure 13:
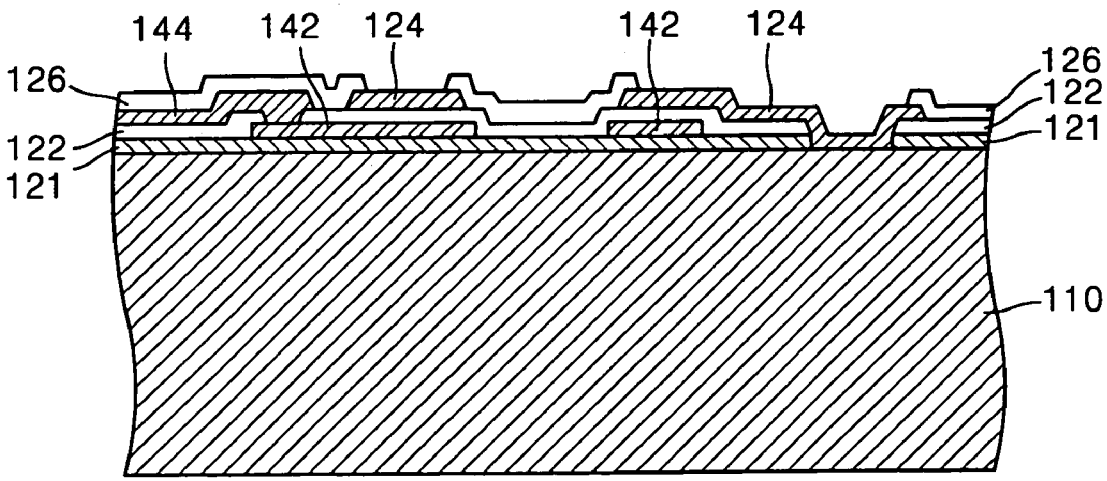

FIG. 13 shows the state in which the third passivation layer 126 has been formed over the entire surface of the resultant structure of FIG. 12. The third passivation layer 126 is formed by depositing tetraethylorthosilicate (TEOS) oxide using plasma enhanced chemical vapor deposition (PECVD) to a thickness of approximately 0.7–3 μm. Then, the third passivation layer 126 is partially etched to expose the heat conductive layer 124.

Figure 14:
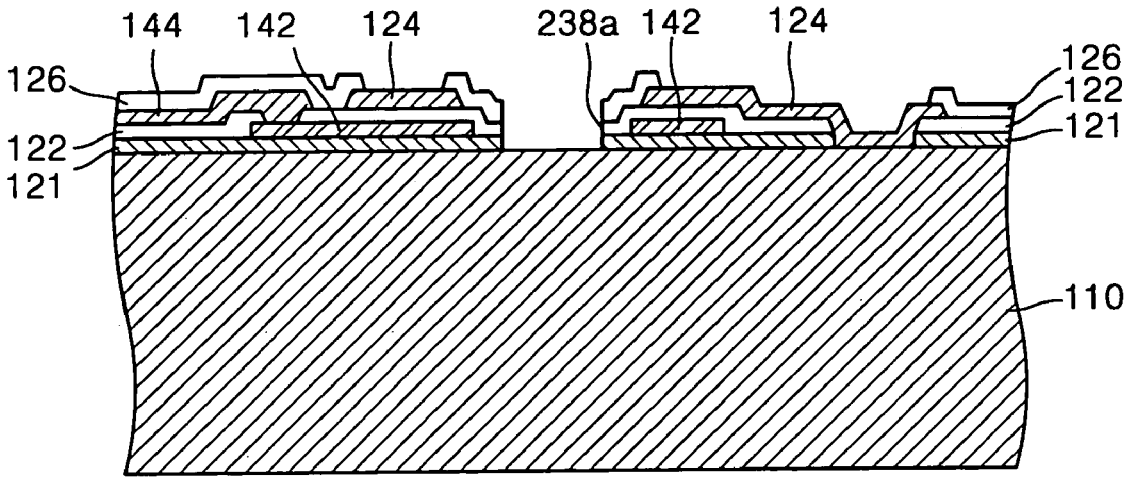

FIG. 14 shows the state in which the lower nozzle 238*a* has been formed. The lower nozzle 238*a* is formed by sequentially etching the third, second, and first passivation layers 126, 122, and 121 on the inside of the heater 142 using a reactive ion etching (RIE) in a sectional shape within the inner boundary of the heater 142.

Figure 15:
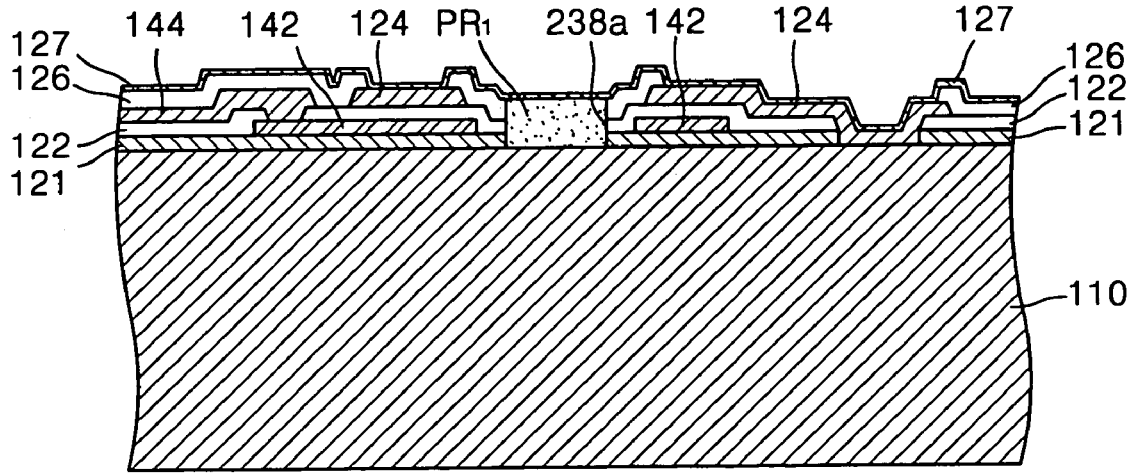

As shown in FIG. 15, a first sacrificial layer $PR_1$ is then formed within the lower nozzle 238*a*. Specifically, a photoresist is applied over the entire surface of the resultant structure of FIG. 14 and patterned to leave only the photoresist filled in the lower nozzle 238*a*. The residual photoresist is used to form the first sacrificial layer $PR_1$ thus maintaining the shape of the lower nozzle 238*a* during the subsequent steps. Then, a seed layer 127 is formed for electroplating over the entire surface of the resulting structure formed A after formation of the first sacrificial layer $PR_1$. To perform the electroplating, the seed layer 127 can be formed by depositing metal having good conductivity, such as copper (Cu), chrome (Cr), titanium (Ti), gold (Au), or nickel (Ni), to a thickness of approximately 500–3,000 Å using sputtering techniques. Meanwhile, the seed layer 127 may be comprised of a plurality of metal layers, each of which can be formed by depositing metal, such as copper (Cu), chrome (Cr), titanium (Ti), gold (Au), or nickel (Ni).

Figure 16:
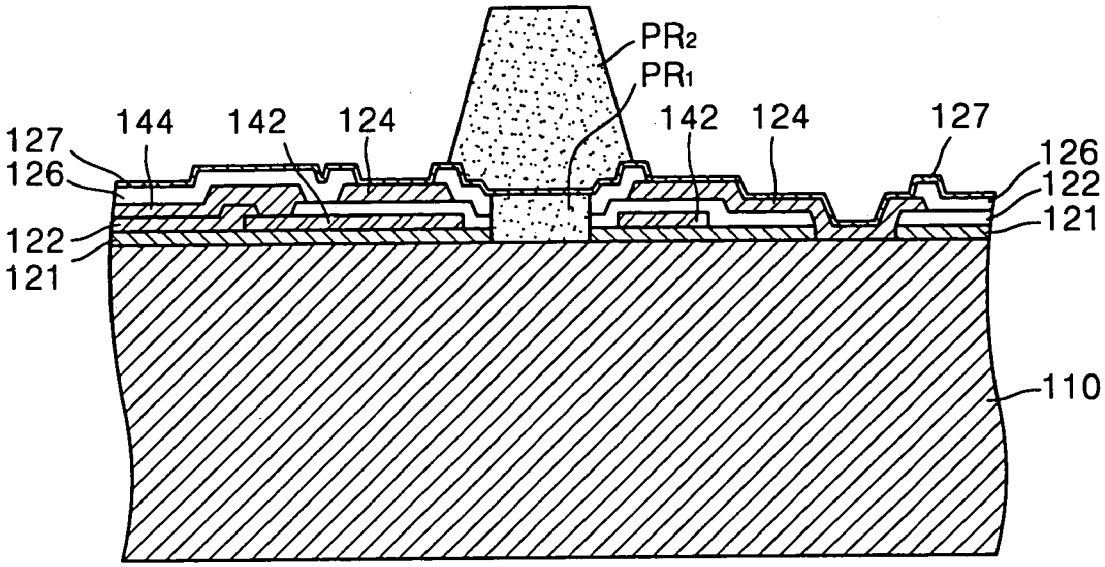

FIG. 16 shows the state in which a second sacrificial layer $PR_2$ for forming the upper nozzle 238*b* has been formed.

Figure 18:
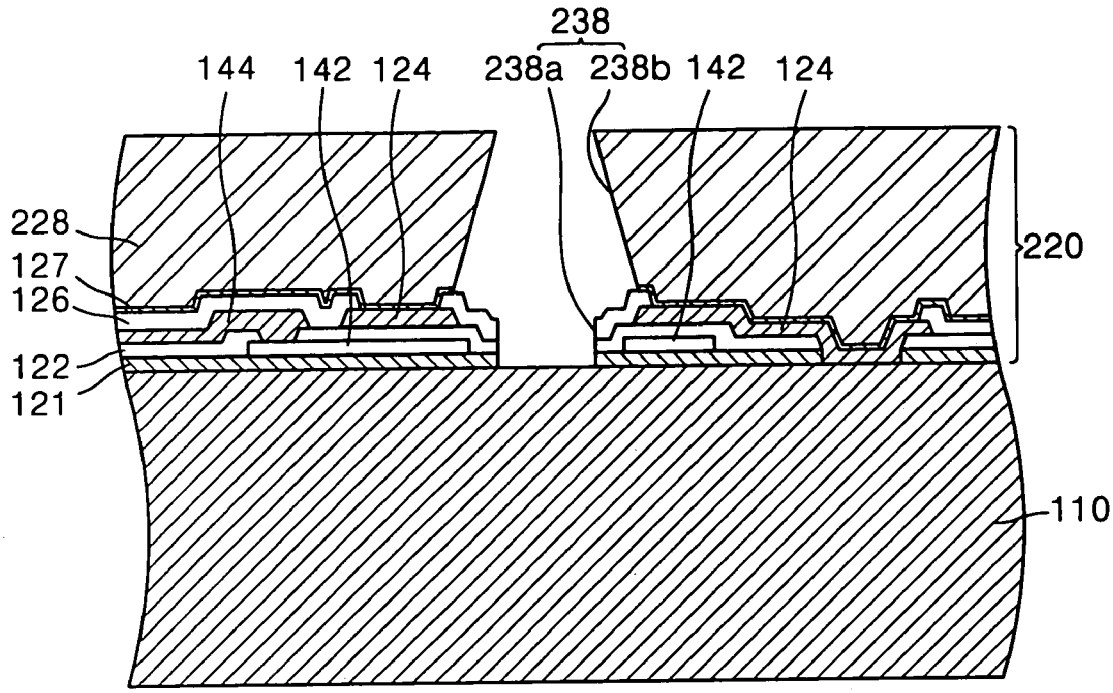

Specifically, a photoresist is applied over the entire surface of seed layer 127 and patterned to leave the photoresist only at a portion where the upper nozzle 238*a* is to be formed as shown in FIG. 18. The residual photoresist is formed in a tapered shape having a diameter that decreases toward the top and acts as the second sacrificial layer $PR_2$ for forming the upper nozzle 238*b* in the subsequent steps.

Meanwhile, if the pillar-shaped nozzle 138 shown in FIG. 6 is to be formed, the second sacrificial layer $PR_2$ is also formed in a pillar-shape. The first and second sacrificial layers $PR_1$ and $PR_2$ may be made from a photosensitive polymer instead of a photoresist.

Figure 17:
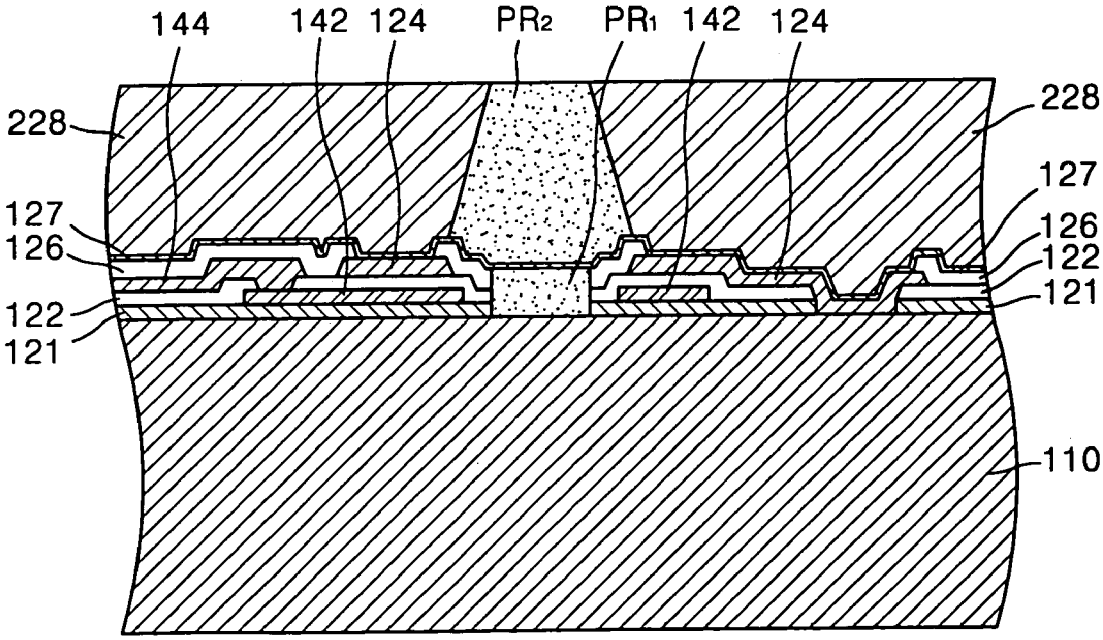

Then, as shown in FIG. 17, the heat dissipating layer 228 is formed from a metal of a predetermined thickness on top of the seed layer 127. The heat dissipating layer 228 can be formed to a thickness of about 10–100 μm by electrically plating nickel (Ni), copper (Cu), or gold (Au) over the surface of the seed layer 127. The electroplating process is completed when the heat dissipating layer 228 is formed to a desired height at which the exit section of the upper nozzle 238*b* is formed, the height being less than that of the second sacrificial layer $PR_2$. The thickness of the heat dissipating layer 228 may be appropriately determined considering the cross-sectional area and shape of the upper nozzle 238*b* and heat dissipation capability.

Since the surface of the heat dissipating layer 228 that has undergone electroplating has irregularities due to the underlying material layers, it may be subsequently planarized by chemical mechanical polishing (CMP).

the second sacrificial layer $PR_2$ for forming the upper nozzle 238*b*, the underlying seed layer 127, and the first sacrificial layer $PR_1$ for maintaining the lower nozzle 238*a* are then sequentially etched to form the complete nozzle 238 by linking the lower and upper nozzles 238*a* and 238*b* and the nozzle plate 220 comprised of the plurality of material layers.

Alternatively, the nozzle 238 and the heat dissipating layer 228 may be formed through the following steps. Referring to FIG. 21, a seed layer 127' for electroplating is formed over the entire surface of the resulting structure of FIG. 14 before forming the first sacrificial layer $PR_1$ for maintaining the structure of the lower nozzle 238*a*. The first sacrificial layer $PR_1$ and the second sacrificial layer $PR_2$ are then sequentially or simultaneously and integrally formed. Next, the heat dissipating layer 228 is formed as shown in FIG. 17, followed by planarization of the surface of the heating dissipating layer 228 by CMP.

Referring to FIG. 18, after the planarization, the second and first sacrificial layers $PR_2$ and $PR_1$, and the underlying seed layer 127' are etched to form the nozzle 238 and nozzle plate 220.

Figure 19:
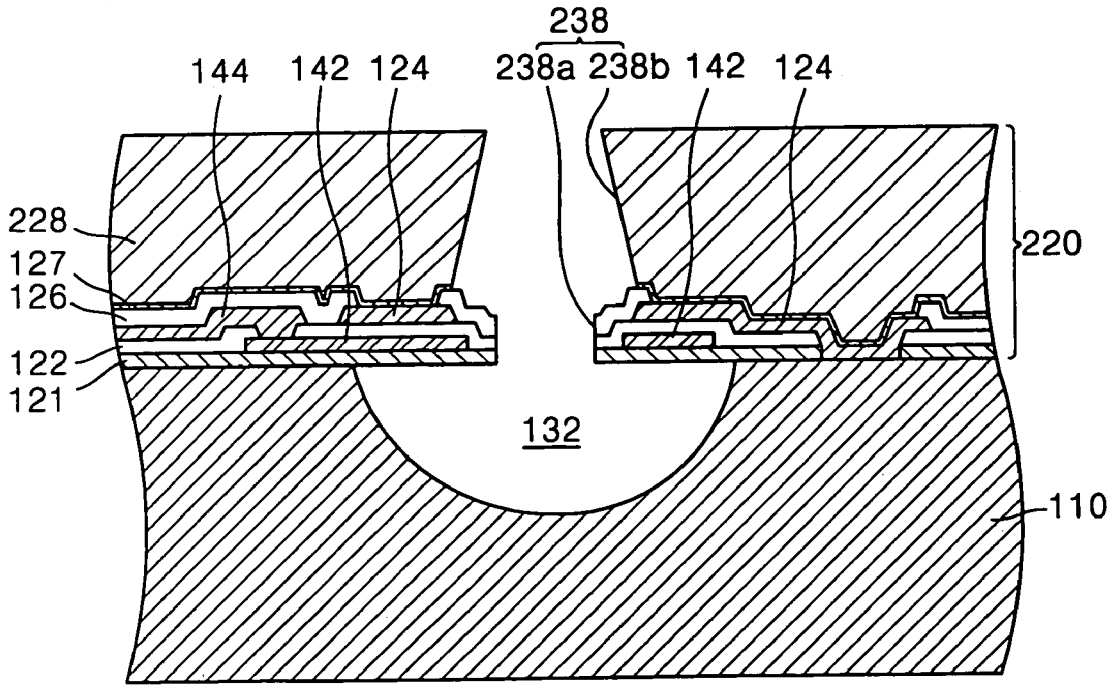

FIG. 19 shows the state in which the ink chamber 132 of a predetermined depth has been formed on the front surface of the substrate 110. The ink chamber 132 can be formed by isotropically etching the substrate 110 exposed by the nozzle 238. That is, dry etching is carried out on the substrate 110 using $XeF_2$ or $BrF_3$ gas as an etch gas for a predetermined period of time to form the hemispherical ink chamber 132 with a depth and a radius of about 20–40 μm as shown in FIG. 19.

Figure 20:
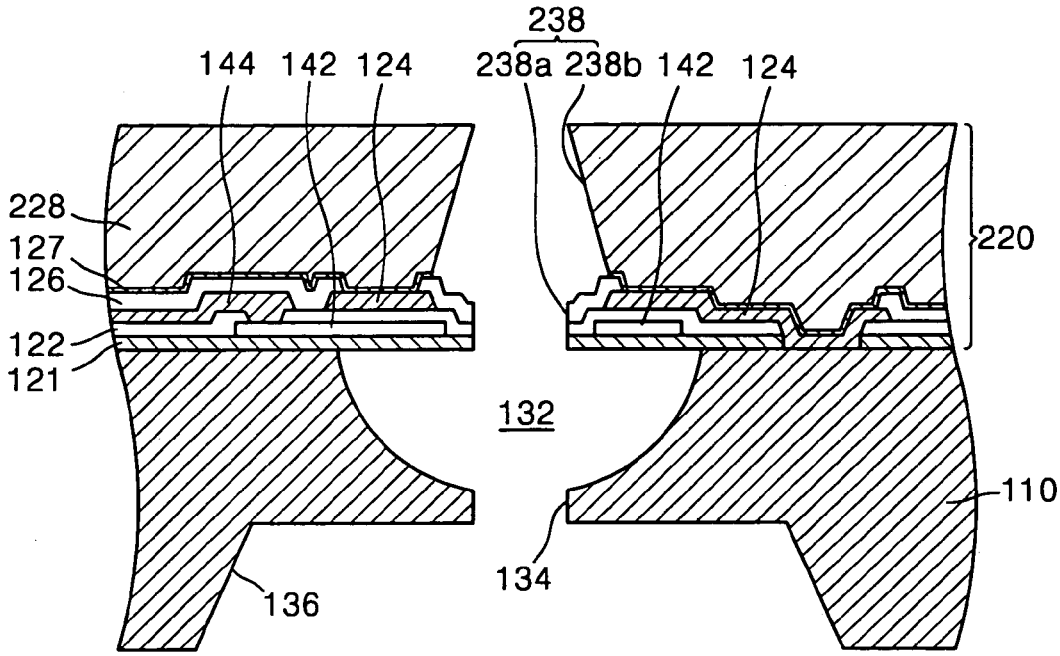
Figure 21:
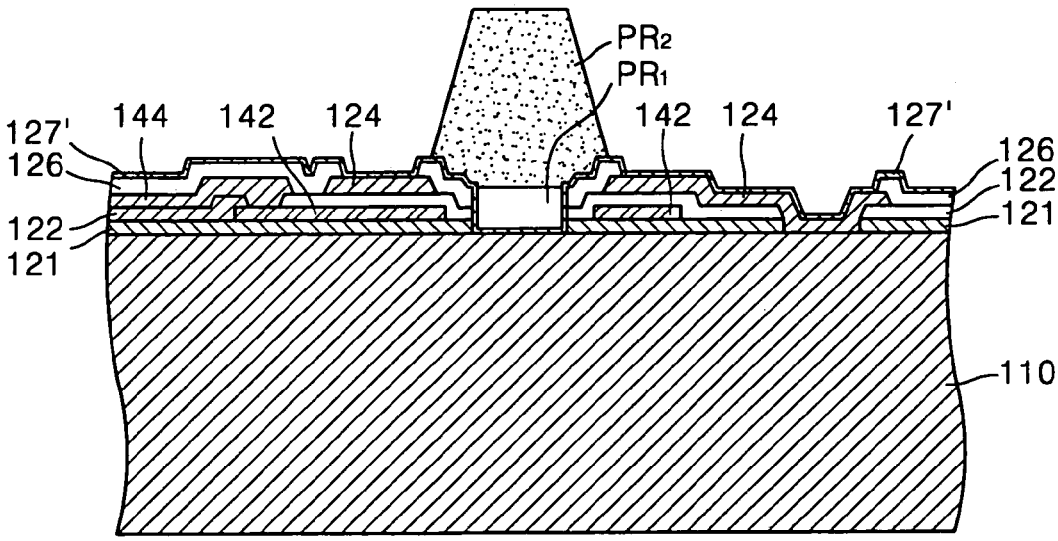
FIG. 21 illustrates an alternate method of forming a seed layer and sacrificial layers.

FIG. 20 shows the state in which the manifold 136 and the ink channel 134 have been formed by etching the substrate 110 from the rear surface. Specifically, an etch mask that limits a region to be etched is formed on the rear surface of the substrate 110, and a wet etching is performed using tetramethyl ammonium hydroxide (TMAH) or potassium hydroxide (KOH) as an etchant to form the manifold 136 having an inclined side surface. Alternatively, the manifold 136 may be formed by anisotropically etching the rear surface of the substrate 110. Subsequently, an etch mask that defines the ink channel 134 is formed on the rear surface of the substrate 110 where the manifold 136 has been formed, and the substrate 110 between the manifold 136 and ink chamber 132 is dry-etched by RIE thus forming the ink channel 134. Meanwhile, the ink channel 134 may be formed by etching the substrate 110 at the bottom of ink chamber 132 through the nozzle 238.

After having undergone the above steps, a monolithic ink-jet printhead according to the present invention having the nozzle plate 220 with the heat dissipating layer 228 made of a metal is completed.

Figure 22:
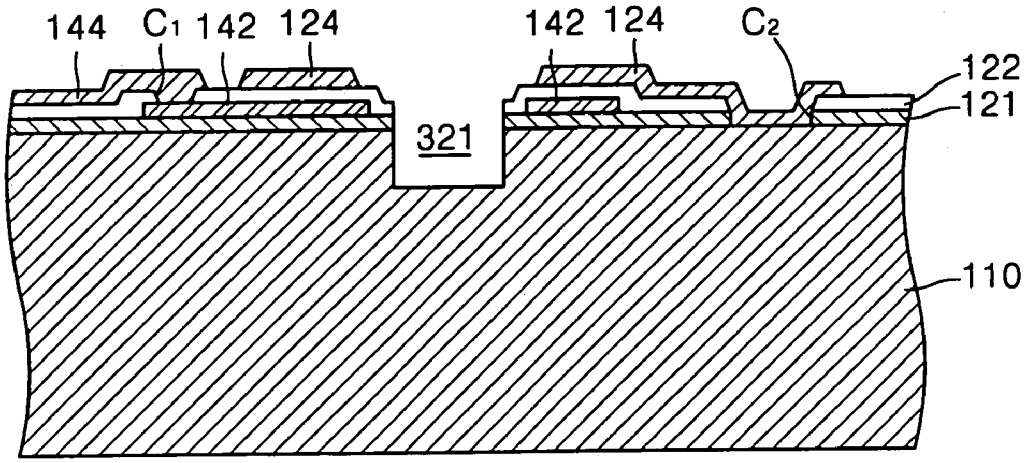
FIGS. 22 through 24 illustrate cross-sectional views for explaining stages in a method of manufacturing an ink-jet printhead having the nozzle plate shown in FIG. 8B according to a preferred embodiment of the present invention.
Figure 23:
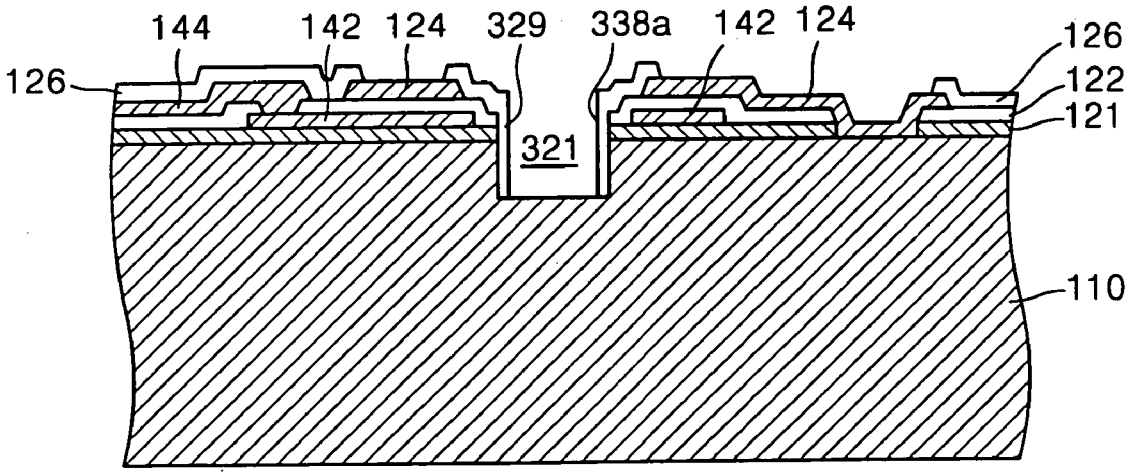
Figure 24:
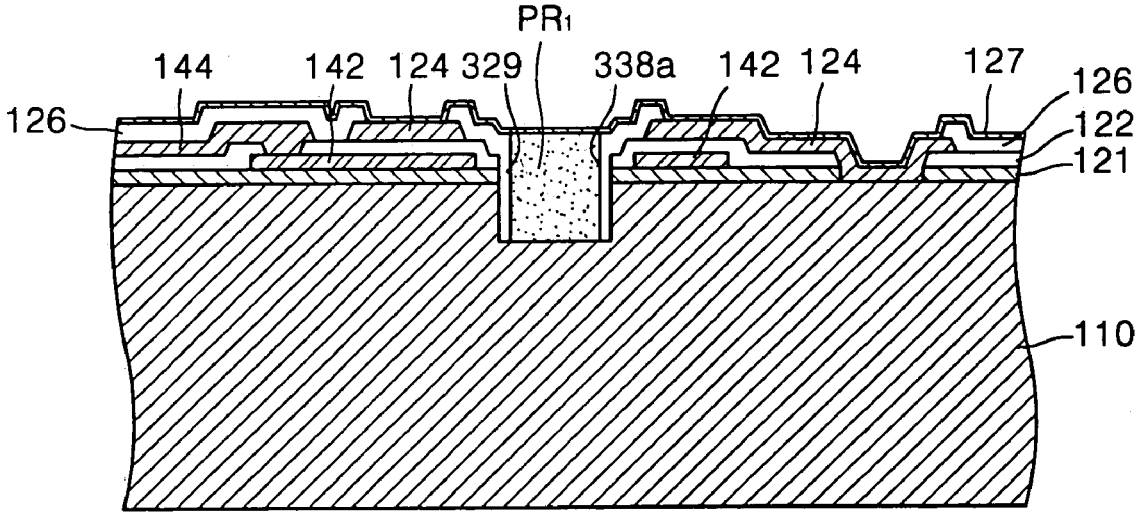

FIGS. 22 through 24 illustrate cross-sectional views for explaining stages in a method of manufacturing an ink-jet printhead having the nozzle plate shown in FIG. 8B according to a preferred embodiment of the present invention.

The method of manufacturing an ink-jet printhead having the nozzle plate 320 shown in FIG. 8B is the same as the manufacturing method of the ink-jet printhead having the nozzle plate 220 shown in FIG. 8A, except that the step of forming the nozzle guide 329 is added. That is, the method is comprised of the same steps as shown in FIGS. 10–12, an additional step of forming the nozzle guide 329, and the same steps as shown in FIGS. 16–20. Thus, the manufacturing method will now be described with respect to this difference.

As shown in FIG. 22, after the step shown in FIG. 12, the second and first passivation layers 122 and 121 are anisotropically etched in a sectional shape within the inner boundary of the heater 142 using reactive ion etching (RIE). The substrate 110 is then anisotropically etched in the same way to form a hole 321 of a predetermined depth. Subsequently, as shown in FIG. 23, the third passivation layer 126 is formed over the entire surface of the resulting structure of FIG. 22. As described above, the third passivation layer 126 may be formed by depositing TEOS oxide by PECVD to a thickness of about 0.7–3 μm. The nozzle guide 329 is formed by the TEOS oxide deposited within the hole 321 and defines the lower nozzle 338*a*. The third passivation layer 126 is then partially etched to expose the heat conductive layer 124, and the bottom surface of the hole 321 is etched to expose the substrate 110.

Alternatively, the hole 321 may be formed after having formed the third passivation layer 126. In this case, another material layer is deposited inside the hole 321 or on the third passivation layer 126 to form the nozzle guide 329.

As shown in FIG. 24, the first sacrificial layer $PR_1$ comprised of a photoresist is then formed in the lower nozzle 338*a* defined by the nozzle guide 329, and the seed layer 127 for electroplating is formed as described above. After having undergone the steps shown in FIGS. 16 through 20 as subsequent steps, an ink-jet printhead with the nozzle guide 329 formed along the lower part of the nozzle 338 as shown in FIG. 8B is completed.

As described above, the monolithic ink-jet printhead and the manufacturing method thereof according to the present invention have the following advantages over the conventional ones.

First, the present invention improves heat sinking capability due to the presence of a heat dissipation layer made of a thick metal, thereby increasing the ink ejection performance and operating frequency while preventing printing error and heater breakage due to overheat during high-speed printing. Furthermore, the temperature of ink within the nozzle due to the improved heat dissipation drops, thereby minimizing changes in surface tension and ink viscosity highly sensitive to temperature, thus allowing the stable high speed ejection.

Second, the present invention makes it possible to provide a sufficient length of the nozzle due to a relatively thick heat dissipating layer and so maintains a meniscus within the nozzle, thereby allowing stable ink refill operation while increasing the directionality of an ink droplet being ejected.

Third, in the present invention, since the upper part of nozzle is formed in the heat dissipating layer made of a plated metal, the nozzle exit has a sharp edge. This improves the ejection performance of an ink droplet while eliminating the problem of the outer surface of a nozzle plate which gets wet with ink.

Fourth, according to the present invention, since a nozzle plate having a nozzle is formed integrally with a substrate having an ink chamber and an ink channel formed thereon, the present invention can provide an ink-jet printhead on a single wafer using a single process. This eliminates the conventional problems of misalignment between the nozzle and ink chamber, thereby increasing the ink ejection performance and manufacturing yield.

Preferred embodiments of the present invention have been disclosed herein and, although specific terms are employed, they are used and are to be interpreted in a generic and descriptive sense only and not for purpose of limitation. For example, materials used to form each element of a printhead according to this invention may not be limited to those described herein. That is, the substrate may be formed of a material having good processibility, other than silicon, and the same is true of a heater, a conductor, a passivation layer, a heat conductive layer, or a heat dissipating layer. In addition, the stacking and formation method for each material are only examples, and a variety of deposition and etching techniques may be adopted. Furthermore, specific numeric values illustrated in each step may vary within a range in which the manufactured printhead can operate normally. In addition, sequence of process steps in a method of manufacturing a printhead according to this invention may differ. Accordingly, it will be understood by those of ordinary skill in the art that various changes in form and details may be made without departing from the spirit and scope of the present invention as set forth in the following claims.

What is claimed is:

1. A monolithic ink-jet printhead, comprising:

a substrate having an ink chamber to be supplied with ink to be ejected on a front surface thereof, a manifold for supplying ink to the ink chamber on a rear surface thereof, and an ink channel in communication with the ink chamber and the manifold;

a nozzle plate including a plurality of passivation layers stacked on the substrate and a heat dissipating layer overlying the plurality of passivation layers, the nozzle plate having a nozzle penetrating the nozzle plate so that ink ejected from the ink chamber is ejected through the nozzle;

a heater formed between adjacent passivation layers of the plurality of passivation layers of the nozzle plate and located above the ink chamber for heating the ink to be supplied within the ink chamber; and a conductor provided between adjacent passivation layers of the plurality of passivation layers of the nozzle plate, the conductor being electrically connected to the heater for applying current across the heater, wherein the heat dissipating layer is made of a thermally conductive metal for dissipating heat from the heater.

2. The printhead as claimed in claim 1, wherein the plurality of passivation layers includes first through third passivation layers sequentially stacked on the substrate, the heater is formed between the first and second passivation layers, and the conductor is located between the second and third passivation layers.

3. The printhead as claimed in claim 1, wherein the heat dissipating layer is made of nickel, copper, or gold.

4. The printhead as claimed in claim 1, wherein the heat dissipating layer is formed by electroplating to a thickness of about 10–100 μm.

5. The printhead as claimed in claim 1, wherein the nozzle plate has a heat conductive layer located above the ink chamber, the heat conductive layer being insulated from the heater and conductor and contacting the substrate and heat dissipating layer.

6. The printhead as claimed in claim 5, wherein the heat conductive layer is made of a metal.

7. The printhead as claimed in claim 5, wherein the conductor and heat conductive layer are made of the same metal.

8. The printhead as claimed in claim 7, wherein the conductor and heat conductive layer are made of aluminum, aluminum alloy, gold, or silver.

9. The printhead as claimed in claim 7, wherein the conductor and heat conductive layer are located on the same passivation layer.

10. The printhead as claimed in claim 5, further comprising:

an insulating-layer interposed between the conductor and the heat conductive layer.

11. The printhead as claimed in claim 1, wherein an upper part of the nozzle is formed in the heat dissipating layer and has a pillar shape.

12. The printhead as claimed in claim 1, wherein an upper part of the nozzle is formed in the heat dissipating layer and a cross-sectional area of the upper part of the nozzle decreases toward an exit at an upper surface of the nozzle.

13. The printhead as claimed in claim 1, wherein the heater is centered around the nozzle.

14. The printhead as claimed in claim 1, wherein a lower part of the nozzle is formed by penetrating the plurality of passivation layers sequentially stacked on the substrate.

15. The printhead as claimed in claim 1, wherein a cross-sectional shape of the ink channel is circular, oval, or polygonal.

16. The printhead as claimed in claim 1, further comprising:

a nozzle guide extending into the ink chamber formed along edges of a lower part of the nozzle.

17. The printhead as claimed in claim 1, wherein the conductor and heat conductive layer are located on the same passivation layer.

18. The printhead as claimed in claim 1, wherein the substrate is made of a silicon wafer.

* * * * *